US008012250B2

(12) United States Patent
Hwang et al.

(10) Patent No.: US 8,012,250 B2
(45) Date of Patent: Sep. 6, 2011

(54) VACUUM CLEANER

(75) Inventors: Man Tae Hwang, Changwon-si (KR); Hae Seock Yang, Changwon-si (KR); Hoi Kil Jeong, Changwon-si (KR); Myung Sig Yoo, Changwon-si (KR); Jae Kyum Kim, Kimhae-si (KR); Moo Hyun Ko, Moonkyung-si (KR); Kie Tak Hyun, Changwon-si (KR); Jong Su Choo, Busan-si (KR); Young Bok Son, Changwon-si (KR); Kyeong Seon Jeong, Changwon-si (KR); Min Park, Busan-si (KR); Sung Hwa Lee, Changwon-si (KR); Il Joong Kim, Masan-si (KR); Jin Hyouk Shin, Busan-si (KR); Gun Ho Ha, Busan-si (KR); Jin Wook Seo, Busan-si (KR); Chang Ho Yun, Changwon-si (KR); Jin Young Kim, Busan-si (KR); Chang Hoon Lee, Changwon-si (KR); Yun Hee Park, Kimhae-si (KR); Hyuk-Min Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 264 days.

(21) Appl. No.: 12/407,964

(22) Filed: Mar. 20, 2009

(65) Prior Publication Data

US 2009/0241286 A1 Oct. 1, 2009

Related U.S. Application Data

(63) Continuation-in-part of application No. 11/565,241, filed on Nov. 30, 2006, now Pat. No. 7,749,295, which is a continuation-in-part of application No. 11/565,206, filed on Nov. 30, 2006, now Pat. No. 7,882,592.

(30) Foreign Application Priority Data

| | | |
|---|---|---|
| Dec. 20, 2005 | (KR) | 2005-0121279 |
| Dec. 20, 2005 | (KR) | 2005-0126270 |
| Dec. 29, 2005 | (KR) | 2005-0134094 |
| Feb. 24, 2006 | (KR) | 2006-0018119 |
| Feb. 24, 2006 | (KR) | 2006-0018120 |
| May 3, 2006 | (KR) | 2006-0040106 |
| May 17, 2006 | (KR) | 2006-0044359 |
| May 17, 2006 | (KR) | 2006-0044362 |
| May 20, 2006 | (KR) | 2006-0045415 |
| May 20, 2006 | (KR) | 2006-0045416 |
| May 23, 2006 | (KR) | 2006-0046077 |
| Sep. 6, 2006 | (KR) | 2006-0085919 |
| Sep. 6, 2006 | (KR) | 2006-0085921 |
| Oct. 10, 2006 | (KR) | 2006-0098191 |
| Feb. 15, 2007 | (KR) | 2007-0015806 |
| Jul. 23, 2007 | (KR) | 2007-0073222 |
| Nov. 15, 2007 | (WO) | PCT/KR2007/005758 |

(51) Int. Cl.
*B01D 49/00* (2006.01)

(52) U.S. Cl. ..... 96/417; 96/423; 55/429; 55/DIG. 3

(58) Field of Classification Search ..... 96/417, 96/423; 55/429, 459.1, DIG. 3
See application file for complete search history.

(56) References Cited

U.S. PATENT DOCUMENTS 83,469 A 10/1868 Crandall (Continued)

FOREIGN PATENT DOCUMENTS

AU 2005229774 8/2006

(Continued)

OTHER PUBLICATIONS

Russian Office Action dated Oct. 19, 2010 issued in Application No. 2009143355 (with English translation).

(Continued)

*Primary Examiner* — Robert A Hopkins

(74) *Attorney, Agent, or Firm* — KED & Associates LLP

(57) ABSTRACT

A vacuum cleaner is disclosed. The vacuum cleaner may include a cleaner body, in which a suction motor is provided; a dust collector selectively attached to the cleaner body, in which a dust container is formed; at least one pressing element that presses dust stored in the dust container; and a drive device that drives the at least one pressing element.

21 Claims, 21 Drawing Sheets

U.S. PATENT DOCUMENTS

| | | | | |
|---|---|---|---|---|
| 2,283,836 | A | 5/1942 | White | |
| 2,714,426 | A | 8/1955 | White | 183/58 |
| 3,367,462 | A | 2/1968 | Bibbens | |
| 4,379,385 | A | 4/1983 | Reinhall | |
| 4,545,794 | A | 10/1985 | Himukai | 55/362 |
| 4,601,082 | A | 7/1986 | Kurz | |
| 4,617,034 | A | 10/1986 | Ikezaki et al. | 55/276 |
| 4,809,394 | A | 3/1989 | Suka et al. | 15/327 |
| 5,033,151 | A | 7/1991 | Kraft et al. | 15/319 |
| 5,135,552 | A | 8/1992 | Weistra | |
| 5,159,738 | A | 11/1992 | Sunagawa et al. | 15/326 |
| 5,233,682 | A | 8/1993 | Abe et al. | |
| 5,251,358 | A | 10/1993 | Moro et al. | |
| 5,265,305 | A | 11/1993 | Kraft et al. | |
| 5,323,483 | A | 6/1994 | Baeg | |
| 5,542,146 | A | 8/1996 | Hoekstra et al. | |
| 6,192,550 | B1 | 2/2001 | Hamada et al. | |
| 6,460,217 | B2 | 10/2002 | Fukushima et al. | 15/346 |
| 6,625,845 | B2 | 9/2003 | Matsumoto et al. | |
| 6,689,225 | B2 | 2/2004 | Illingworth | |
| 6,694,917 | B1 | 2/2004 | Wang | |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 | 8/2004 | Choi | 15/352 |
| 6,922,868 | B1 | 8/2005 | Jeong | |
| 7,028,369 | B2 | 4/2006 | Park et al. | 15/353 |
| 7,152,276 | B2 | 12/2006 | Jin et al. | |
| 7,351,269 | B2 | 4/2008 | Yau | 55/297 |
| 7,475,449 | B2 | 1/2009 | Lee | 15/326 |
| 7,481,868 | B2 * | 1/2009 | Lee et al. | 95/273 |
| 7,547,340 | B2 | 6/2009 | Park | 55/429 |
| 7,582,128 | B2 | 9/2009 | Hwang et al. | |
| 7,601,188 | B2 | 10/2009 | Hwang et al. | 55/343 |
| 7,608,123 | B2 | 10/2009 | Pineschi | 55/429 |
| 7,640,625 | B2 | 1/2010 | Oh et al. | 15/352 |
| 7,644,469 | B2 | 1/2010 | Beers et al. | 15/319 |
| 7,647,672 | B2 | 1/2010 | Nam et al. | 15/352 |
| 7,704,290 | B2 | 4/2010 | Oh | 55/295 |
| 7,749,295 | B2 | 7/2010 | Hwang et al. | 55/428 |
| 7,770,253 | B2 | 8/2010 | Ha et al. | 15/319 |
| 7,785,381 | B2 | 8/2010 | Oh et al. | 55/300 |
| 7,785,396 | B2 | 8/2010 | Hwang et al. | 95/1 |
| 7,854,782 | B2 | 12/2010 | Oh et al. | 55/429 |
| 7,958,598 | B2 | 6/2011 | Yun et al. | |
| 2001/0025395 | A1 | 10/2001 | Matsumoto et al. | 15/353 |
| 2002/0073505 | A1 | 6/2002 | Bolden | |
| 2002/0088079 | A1 | 7/2002 | Oh | |
| 2002/0124538 | A1 | 9/2002 | Oh et al. | |
| 2004/0211025 | A1 | 10/2004 | Jung et al. | |
| 2004/0261216 | A1 | 12/2004 | Choi et al. | 15/352 |
| 2005/0091787 | A1 | 5/2005 | Bair et al. | |
| 2005/0138763 | A1 | 6/2005 | Tanner et al. | |
| 2005/0172584 | A1 | 8/2005 | Oh et al. | |
| 2005/0252179 | A1 | 11/2005 | Oh et al. | |
| 2006/0123750 | A1 | 6/2006 | Lee et al. | 55/428 |
| 2006/0230722 | A1 | 10/2006 | Oh et al. | |
| 2007/0136980 | A1 | 6/2007 | Fujiwara et al. | |
| 2007/0143953 | A1 | 6/2007 | Hwang et al. | |
| 2007/0209149 | A1 | 9/2007 | Lee | 15/352 |
| 2007/0209339 | A1 | 9/2007 | Conrad | |
| 2008/0023035 | A1 | 1/2008 | Ha et al. | 134/18 |
| 2008/0023036 | A1 | 1/2008 | Ha et al. | 134/21 |
| 2008/0047094 | A1 | 2/2008 | Ha et al. | |
| 2008/0052870 | A1 | 3/2008 | Lee et al. | |
| 2008/0172824 | A1 | 7/2008 | Yun et al. | 15/352 |
| 2008/0172993 | A1 | 7/2008 | Yun et al. | 55/337 |
| 2008/0263816 | A1 | 10/2008 | Oh et al. | 15/347 |
| 2008/0264007 | A1 | 10/2008 | Oh et al. | 55/304 |
| 2008/0264014 | A1 | 10/2008 | Oh et al. | 55/423 |
| 2008/0264015 | A1 | 10/2008 | Oh et al. | 55/429 |
| 2008/0264016 | A1 | 10/2008 | Oh et al. | 55/429 |
| 2009/0178231 | A1 | 7/2009 | Hwang et al. | 15/347 |
| 2009/0178235 | A1 | 7/2009 | Yun et al. | 15/352 |
| 2009/0178236 | A1 | 7/2009 | Yun et al. | 15/352 |
| 2009/0229072 | A1 | 9/2009 | Hwang et al. | 15/352 |
| 2009/0229073 | A1 | 9/2009 | Hwang et al. | 15/352 |
| 2009/0235956 | A1 | 9/2009 | Hwang et al. | 134/21 |
| 2009/0241286 | A1 | 10/2009 | Hwang et al. | 15/347 |
| 2009/0249578 | A1 | 10/2009 | Hwang et al. | 15/352 |
| 2009/0255083 | A1 | 10/2009 | Hwang et al. | 15/347 |
| 2009/0266382 | A1 | 10/2009 | Hwang et al. | 134/21 |
| 2009/0293221 | A1 | 12/2009 | Hwang et al. | 15/347 |
| 2009/0293223 | A1 | 12/2009 | Hwang et al. | 15/352 |
| 2009/0293224 | A1 | 12/2009 | Hyun et al. | 15/353 |
| 2009/0293915 | A1 | 12/2009 | Hwang et al. | 134/21 |

FOREIGN PATENT DOCUMENTS

| | | | |
|---|---|---|---|
| AU | 2007200406 | B2 | 9/2007 |
| CN | 2162679 | | 4/1994 |
| CN | 2186039 | | 12/1994 |
| CN | 2409894 | | 12/2000 |
| CN | 1334061 | | 2/2002 |
| CN | 1434749 | A | 8/2003 |
| CN | 1593324 | | 3/2005 |
| CN | 1695537 | | 11/2005 |
| CN | 1695538 | | 11/2005 |
| CN | 1777385 | | 5/2006 |
| CN | 1778246 | | 5/2006 |
| DE | 102 40 618 | | 9/2003 |
| EP | 1 371 318 | A2 | 12/2003 |
| EP | 1 671 569 | | 6/2006 |
| EP | 1 671 570 | | 6/2006 |
| EP | 01 136 028 | | 7/2006 |
| EP | 1 733 669 | | 12/2006 |
| EP | 1857032 | | 11/2007 |
| FR | 2 823 091 | | 10/2002 |
| GB | 2 368 516 | | 5/2002 |
| GB | 2 377 881 | | 1/2003 |
| GB | 2 388 769 | | 4/2004 |
| GB | 2404887 | | 2/2005 |
| GB | 2 406 064 | | 3/2005 |
| GB | 2416721 | | 2/2006 |
| GB | 2466625 | | 6/2010 |
| JP | 1972-14759 | | 8/1972 |
| JP | 50-022355 | | 3/1975 |
| JP | 53-051663 | | 5/1978 |
| JP | 54-28457 | | 3/1979 |
| JP | 54-51259 | | 4/1979 |
| JP | 54-085560 | | 7/1979 |
| JP | 54-085561 | | 7/1979 |
| JP | 54-119272 | | 8/1979 |
| JP | 54-114358 | | 9/1979 |
| JP | 54-114366 | | 9/1979 |
| JP | 54-114367 | | 9/1979 |
| JP | 54161751 | | 12/1979 |
| JP | 55-74553 | | 6/1980 |
| JP | 56-26044 | | 3/1981 |
| JP | 58-84066 | A | 5/1983 |
| JP | 58-175532 | | 10/1983 |
| JP | 58-218934 | | 12/1983 |
| JP | 59-125354 | | 8/1984 |
| JP | 64-029246 | | 1/1989 |
| JP | 02-007927 | | 1/1990 |
| JP | 4-116933 | U | 10/1992 |
| JP | 06-054778 | | 3/1994 |
| JP | 7-241265 | | 9/1995 |
| JP | 07-313412 | | 12/1995 |
| JP | 408000514 | | 1/1996 |
| JP | 08-112223 | A | 5/1996 |
| JP | 08-140907 | | 6/1996 |
| JP | 10-243900 | | 9/1998 |
| JP | 11-004789 | | 1/1999 |
| JP | 2000-262449 | | 9/2000 |
| JP | 2002-143060 | | 5/2002 |
| JP | 2002-187336 | | 7/2002 |
| JP | 2002-360474 | | 12/2002 |
| JP | 2003-019097 | | 1/2003 |
| JP | 2003-119575 | | 4/2003 |
| JP | 2003-125995 | | 5/2003 |
| JP | 2003-190056 | A | 7/2003 |
| JP | 2003-199695 | | 7/2003 |
| JP | 2003-310502 | | 11/2003 |
| JP | 2003-310506 | A | 11/2003 |
| JP | 2004-065357 | | 3/2004 |
| JP | 2004-528087 | A | 9/2004 |
| JP | 2004-528876 | | 9/2004 |

| | | | |
|---|---|---|---|
| JP | 2005-34213 | | 2/2005 |
| JP | 2005-324002 | | 11/2005 |
| JP | 06-061439 | | 3/2006 |
| JP | 2006-068500 | | 3/2006 |
| JP | 3119575 | | 3/2006 |
| JP | 2006-340972 | | 12/2006 |
| JP | 2007-007381 | A | 1/2007 |
| JP | 2008-73066 | | 4/2008 |
| JP | 2003-524522 | | 8/2008 |
| KR | 1993-0008369 | | 8/1993 |
| KR | 2002-0091510 | | 12/2002 |
| KR | 10-2005-0005611 | | 1/2005 |
| KR | 10-2005-013694 | | 2/2005 |
| KR | 10-0546629 | B1 | 1/2006 |
| KR | 10-0553042 | B1 | 2/2006 |
| KR | 10-2006-031442 | | 4/2006 |
| KR | 2006-0116992 | | 11/2006 |
| KR | 10-0730956 | | 6/2007 |
| KR | 10-2007-084834 | | 8/2007 |
| KR | 10-2007-088022 | | 8/2007 |
| KR | 10-0800188 | | 1/2008 |
| KR | 10-0800189 | | 1/2008 |
| KR | 10-0838886 | | 6/2008 |
| KR | 10-0838887 | | 6/2008 |
| RU | 2172132 | | 8/2001 |
| RU | 2 243 714 | | 1/2005 |
| RU | 2 269 919 | | 9/2005 |
| SU | 1326236 | | 7/1987 |
| WO | WO 00/74548 | | 12/2000 |
| WO | WO/01/35809 | | 5/2001 |
| WO | WO 01/60524 | | 8/2001 |
| WO | WO 2004/064591 | | 8/2004 |
| WO | WO2005099545 | | 10/2005 |

OTHER PUBLICATIONS

Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
Russian Office Action dated Oct. 4, 2007 (2007103555) (translation).
Russian Office Action dated Oct. 12, 2007 (2007103557).
Korean Office Action dated Mar. 25, 2008 (016285635).
Australian Office Action dated Apr. 15, 2008 (2007200407).
Australian Office Action dated Apr. 24, 2008 (2007200409).
European Office Action dated May 8, 2008 (07101388.2-2316).
Korean Office Action dated Sep. 30, 2008 (050567614).
Chinese Office Action dated Dec. 12, 2008 (200710002992.1) (translation).
U.S. Office Action dated May 13, 2009 (U.S. Appl. No. 11/965,133).
Chinese Office Action dated May 22, 2009 (200710002992.1) (translation).
Japanese Office Action dated Jul. 28, 2009 (2007-066748).
Chinese Office Action dated Aug. 21, 2009 (200710002991.7) (translation).
U.S. Office Action dated Sep. 10, 2009 (U.S. Appl. No. 11/565,241).
U.S. Office Action dated Oct. 6, 2009 (U.S. Appl. No. 12/406,803).
European Search Report dated Oct. 15, 2009. (0162556.0-2316).
Japanese Office Action dated Nov. 4, 2009. (2007-019770).
Chinese Office Action dated Nov. 13, 2009 (200710085701.X) (translation).
Canadian Office Action dated Nov. 18, 2009 (2) (50514-26) (50514-27).
Japanese Office Action dated Nov. 25, 2009 (2007-019861).
Chinese Office Action dated Dec. 11, 2009 (200710002992.1).
Notice of Allowance dated Jan. 13, 2010 (U.S. Appl. No. 11/965,133).
Notice of Allowance dated Feb. 19, 2010 (U.S. Appl. No. 11/565,241).
Notice of Allowance dated Feb. 24, 2010 (U.S. Appl. No. 11/831,564).
European Search Report dated Jan. 20, 2010.
Chinese Office Action dated Feb. 5, 2010. (with translation).
U.S. Appl. No. 11/965,133 Notice of Allowance dated Jan. 13, 2010.
U.S. Appl. No. 11/565,241 Notice of Allowance dated Feb. 19, 2010.
U.S. Appl. No. 11/831,564 Notice of Allowance dated Feb. 24, 2010.
Korean Office Action dated Mar. 18, 2010.
Korean Office Action dated Mar. 25, 2010.
U.S. Office Action U.S. Appl. No. 11/565,206 dated Apr. 19, 2010.
U.S. Notice of Allowance U.S. Appl. No. 11/831,519 dated Apr. 21, 2010.
Japanese Office Action dated May 13, 2010.
U.S. Office Action U.S. Appl. No. 11/831,473 dated May 14, 2010.
U.S. Office Action U.S. Appl. No. 12/406,803 dated May 26, 2010.
U.S. Office Action U.S. Appl. No. 11/965,133 dated Jul. 9, 2010.
Canadian Office Action dated Jun. 30, 2010.
U.S. Office Action U.S. Appl. No. 12/408,066 dated Jul. 23, 2010.
U.S. Office Action U.S. Appl. No. 12/406,779 dated Aug. 18, 2010.
Japanese Office Action dated Aug. 3, 2010.
U.S. Office Action U.S. Appl. No. 11/831,473 dated Sep. 1, 2010.
Russian Office Action dated Sep. 28, 2007 issued in Application No. 2007103559 (translation only).
Australian Office Action dated Apr. 17, 2008 issued in Application No. 2007200408.
Russian Office Action dated Apr. 21, 2008 issued in Application No. 2007103560 (with translation).
Australian Office Action dated Jun. 3, 2008 issued in Application No. 2006249267.
Japanese Office Action dated Nov. 6, 2008 issued in Application No. 2006-333685.
Russian Office Action dated Mar. 25, 2009 issued in Application No. 2008102660 (with translation).
Australian Office Action dated Apr. 16, 2009 issued in Application No. 2008200340.
Chinese Office Action dated Aug. 21, 2009 issued in Application No. 200810008716.0 (with translation).
Japanese Office Action dated Nov. 25, 2009 issued in Application No. 2007-021083.
Japanese Office Action dated Nov. 25, 2009 issued in Application No. 2007-066748.
Korean Office Action dated Aug. 29, 2008.
Japanese Office Action dated Sep. 18, 2008.
International Search Report and Written Opinion dated Dec. 10, 2008.
Japanese Office Action dated Dec. 24, 2008.
Chinese Office Action dated Feb. 6, 2009.
Japanese Office Action dated Mar. 12, 2009.
Japanese Office Action dated Mar. 12, 2009.
Japanese Office Action dated Mar. 13, 2009.
Chinese Office Action dated Apr. 3, 2009 (translation).
Chinese Office Action dated May 8, 2009 (translation).
Japanese Office Action dated May 22, 2009.
Chinese Office Action dated Jun. 5, 2009 (translation).
European Search Report dated Jun. 16, 2009 (in English).
Korean Office Action dated Jun. 19, 2009.
Chinese Office Action dated Jul. 3, 2009 (with translation).
Japanese Office Action dated Jul. 28, 2009 (with translation).
U.S. Office Action dated Feb. 11, 2008 (U.S. Appl. No. 11/831,473).
U.S. Office Action dated Feb. 11, 2008 (U.S. Appl. No. 11/831,564).
U.S. Office Action dated Jul. 24, 2008 (U.S. Appl. No. 11/831,473).
U.S. Office Action dated Jul. 28, 2008 (U.S. Appl. No. 11/712,958).
U.S. Office Action dated Aug. 28, 2008 (U.S. Appl. No. 11/713,022).
U.S. Office Action dated Sep. 19, 2008 (U.S. Appl. No. 11/831,564).
U.S. Office Action dated Oct. 20, 2008 (U.S. Appl. No. 11/831,473).
U.S. Office Action dated Mar. 9, 2009 (U.S. Appl. No. 11/713,022).
U.S. Office Action dated May 28, 2009 (U.S. Appl. No. 11/831,473).
U.S. Office Action dated Sep. 3, 2009 (U.S. Appl. No. 11/831,564).
Korean Office Action dated Sep. 17, 2010 issued in Application No. 10-2008-0065806.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
U.S. Office Action issued in U.S. Appl. No. 12/406,779 dated Feb. 3, 2011.

U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6-2316/1852048).
Russian Office Action dated Feb. 2, 2011 (Application No. 2009143355) (with translation).
Japanese Office Action dated Apr. 7, 2011. (2010-005365).
U.S. Office Action issued in U.S. Appl. No. 12/407,983 dated Jun. 21, 2011.
U.S. Notice of Allowance issued in U.S. Appl. No. 12/407,293 dated Jun. 29, 2011.
U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.

* cited by examiner

VACUUM CLEANER

This application is a Continuation in Part of 1) U.S. patent application Ser. No. 11/565,241, now U.S. Pat. No. 7,749,295 filed Nov. 30, 2006, which is a Continuation in Part of U.S. patent application Ser. No. 11/565,206, now U.S. Pat. No. 7,882,592 filed Nov. 30, 2006, which claims priority to Korean Patent Application Nos. 2005-0121279 filed in Korea on Dec. 20, 2005, 2005-0126270 filed in Korea on Dec. 20, 2005, 2005-0134094 filed in Korea on Dec. 29, 2005, 2006-0018119 filed in Korea on Feb. 24, 2006, 2006-0018120 filed in Korea on Feb. 24, 2006, 2006-0040106 filed in Korea on May 3, 2006, 2006-0045415 filed in Korea on May 20, 2006, 2006-0045416 filed in Korea on May 20, 2006, 2006-0046077 filed in Korea on May 23, 2006, 2006-0044359 filed in Korea on May 17, 2006, 2006-0044362 filed in Korea on May 17, 2006, 2006-0085919 filed in Korea on Sep. 6, 2006, 2006-0085921 filed in Korea on Sep. 6, 2006, 2006-0085921 filed in Korea on Sep. 16, 2006, and 2006-0098191 filed in Korea on Oct. 10, 2006, and 2) PCT Application No. PCT/KR2007/005758, filed Nov. 15, 2007, which claims priority to Korean Patent Application No(s). 10-2007-0015806 filed in Korea on Feb. 15, 2007 and 10-2007-0073222 filed in Korea on Jul. 23, 2007.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
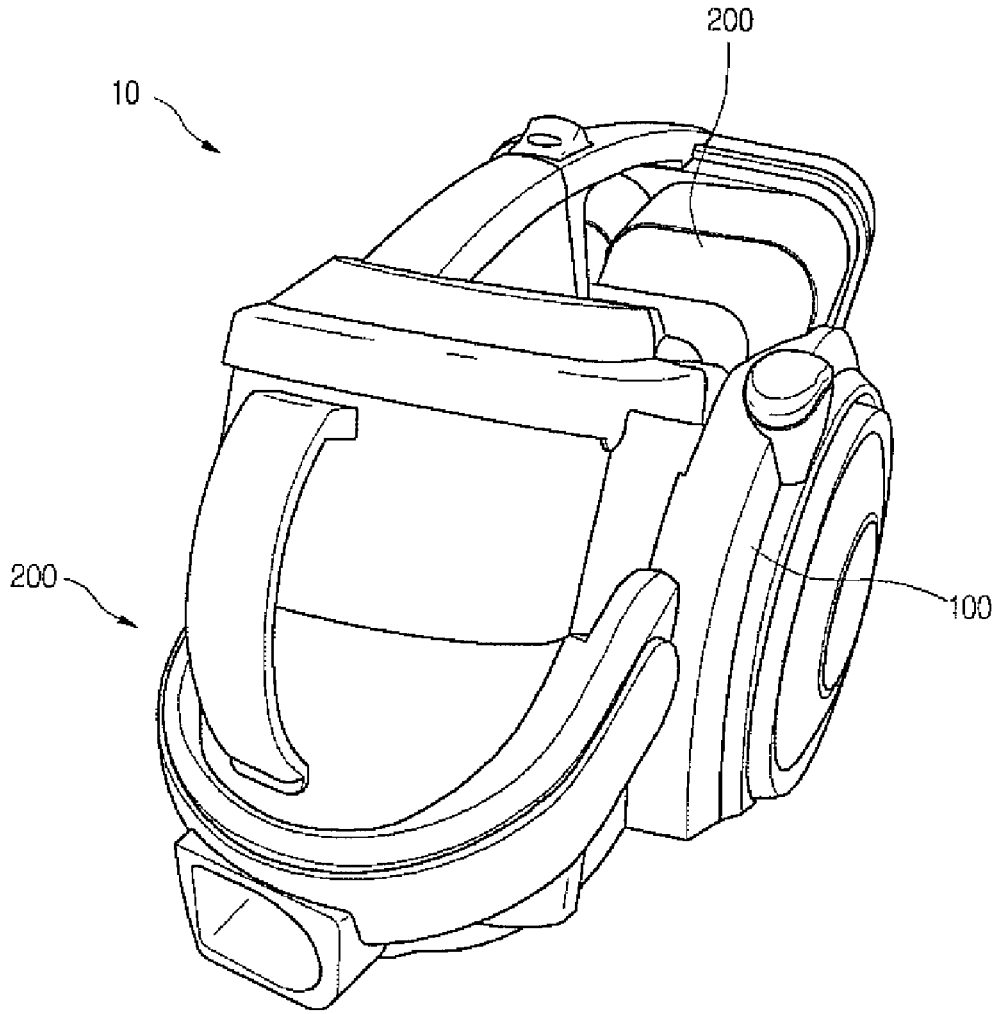
FIG. 1 is a front, perspective view of a vacuum cleaner according to an embodiment.

Hereinafter, embodiments will be described in detail with reference to the accompanying drawings. Where possible, like reference numerals have been used to indicate like elements.

Generally, a vacuum cleaner is an appliance that sucks air containing particles using a suction force of a suction motor into a body thereof and filters off the particles in the body. The vacuum cleaner may include an intake nozzle that sucks air containing particles or impurities, a cleaner body that communicates with the intake nozzle, an extension pipe that guides the air sucked in by the intake nozzle into the cleaner body, and a connecting pipe that connects the extension pipe with the cleaner body. An intake port may be formed at a lower surface of the intake nozzle so that air containing particles may be sucked off of a floor to be cleaned.

A suction motor that generates a sucking force to suck in air containing particles may be provided in the cleaner body. A dust collector that stores impurities separated from polluted air may be detachably provided in the cleaner body.

More particularly, the dust collector may include a dust separator that separates impurities from the air sucked into the dust collector, and a dust container that stores the impurities separated by the dust separator. If an operation of the vacuum cleaner is stopped while separating impurities from polluted air, the separated impurities are stored in the dust container at low density.

In related art dust collectors, since the dust stored in the dust container has a large volume with respect to its weight, there is an inconvenience in that the dust of the dust container has to be frequently cleaned to maintain a dust collecting performance. Therefore, in order to increase a convenience of using the cleaner, efforts have been made to maximize a capacity of dust stored in the dust collector, as well as to enhance dust-collecting performance.

Figure 2:
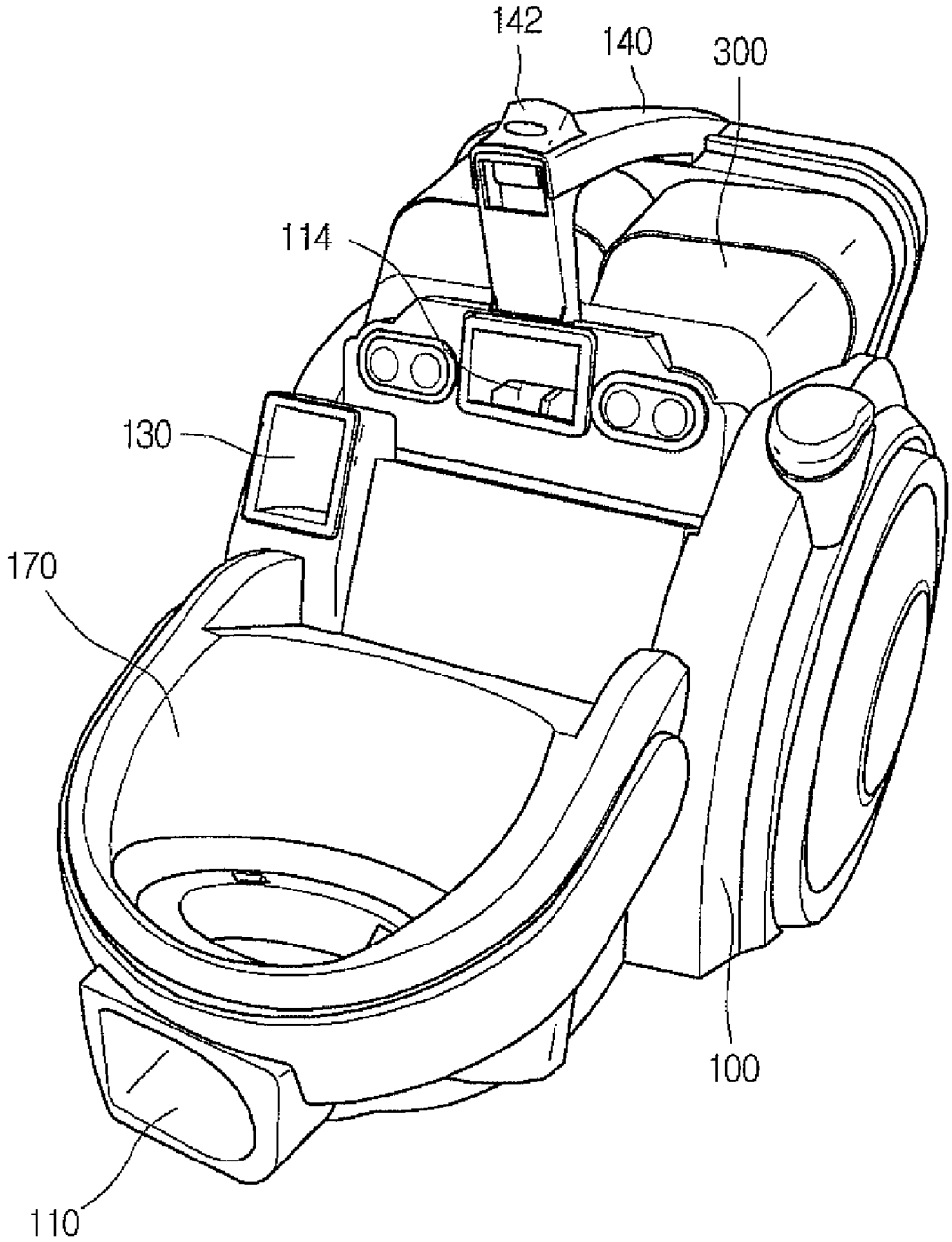
FIG. 2 is a front, perspective view of a vacuum cleaner from which a dust collector is separated.
Figure 3:
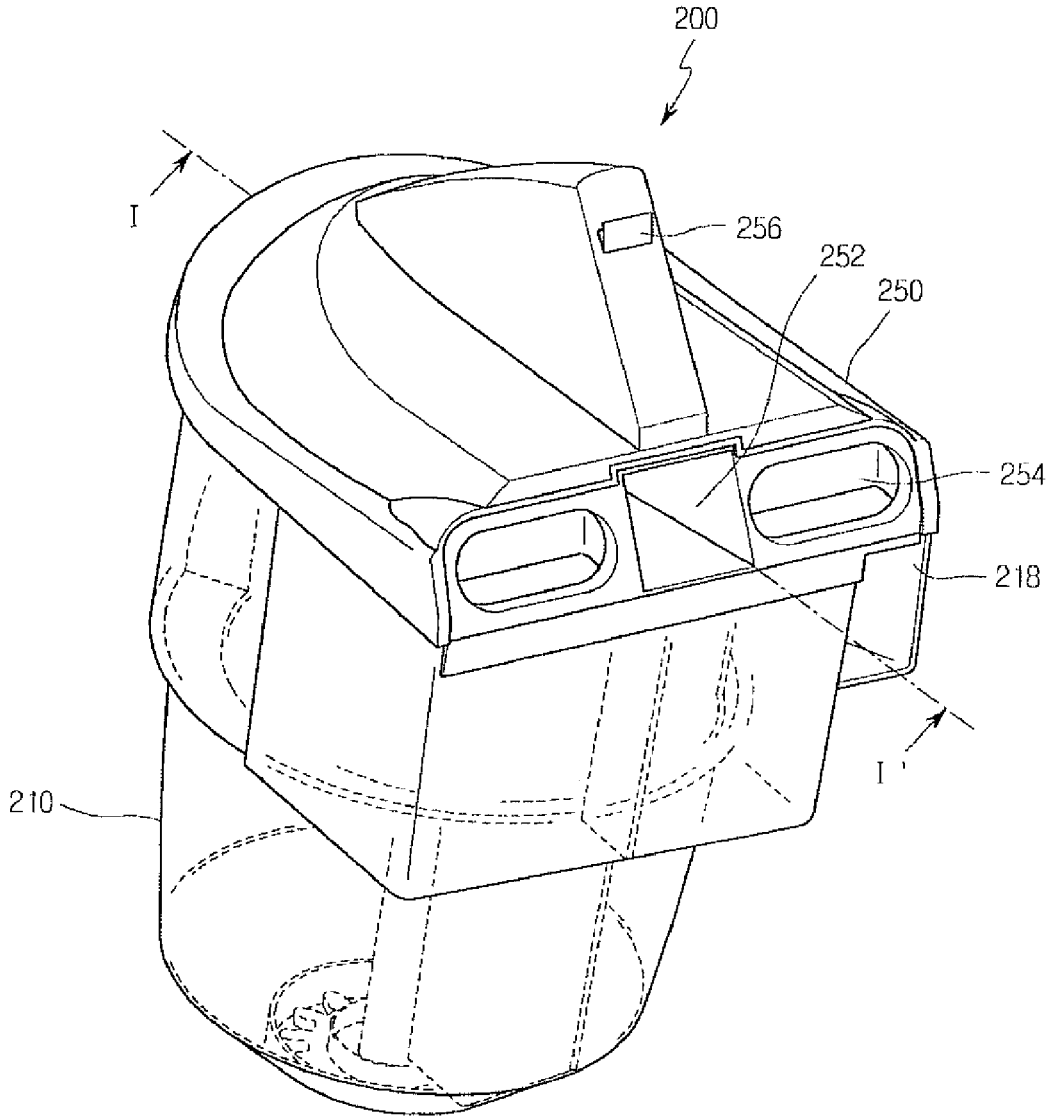
FIG. 3 is a rear, perspective view of a dust collector of the vacuum cleaner of FIG. 1-2.

FIG. 1 is a front, perspective view of a vacuum cleaner according to an embodiment. FIG. 2 is a front, perspective view of a vacuum cleaner from which a dust collector is separated. FIG. 3 is a rear, perspective view of a dust collector of the vacuum cleaner of FIGS. 1-2.

Referring to FIGS. 1 to 3, a vacuum cleaner 10 according to an embodiment may include a cleaner body 100, in which a suction motor (not shown) that generates a sucking force may be provided, and a dust separating device that separates dust from air sucked into the cleaner body 100. The vacuum cleaner may also include an intake nozzle that sucks air containing dust off of a floor and a connection device that connects the intake nozzle to the cleaner body 100, though not illustrated. In this embodiment, the basic configurations of the intake nozzle and the connection device are known, and therefore detailed description has been omitted.

More particularly, a body intake port 110, through which air containing dust sucked in by the intake nozzle passes, may be formed at a bottom of a front surface of the cleaner body 100, and a body discharge port (not shown) that discharges air separated from dust to the outside may be formed in one side of the cleaner body 100. A body handle 140, which is grabable by a user, may be formed on an upper part of the cleaner body 100.

The dust separating device may include a dust collector 200, in which a primary cyclone device 230, which will be explained later, that separates dust from air introduced therein is provided, and a secondary cyclone device 300, which is provided in the cleaner body 100, that re-separates dust from the air initially separated by the primary cyclone device 230. The dust collector 200 may be detachably mounted on a dust collector mounting element 170 formed in a front of the cleaner body 100. An attachment/detachment lever 142 may be provided in the handle 140 of the cleaner body 100, and an engagement end 256 that engages with the attachment/detachment lever 142 may be formed in the dust collector 200.

Further, the dust collector 200 may include the primary cyclone device 230 that forms a cyclonic flow, and a dust collector body 210, in which a dust container that stores the dust separated by the primary cyclone device 230 may be formed. The dust collector 200 may communicate with the cleaner body 100 and the secondary cyclone device 300, as the dust collector 200 may be attached to the cleaner body 100.

In the cleaner body 100, an air outlet 130 that discharges air sucked into the cleaner body to the dust collector 200 may be formed. A first air inlet 218 that introduces air from the air outlet 130 may also be provided in the dust collector 200.

A first air outlet 252, through which air separated from the dust by the primary cyclone device 230 may be discharged, may be formed in the dust collector 200, and a connecting channel 114, into which the air discharged through the first air outlet 252 may be introduced, may be formed in the cleaner body 100. The air introduced into the connecting channel 114 may be introduced into the secondary cyclone device 300.

The secondary cyclone device 300 may include a plurality of cyclones. The dust separated by the secondary cyclone device 300 may be stored in the dust collector 200. A dust inlet 254, into which the dust separated by the secondary cyclone device 300 may be introduced, may be formed in the dust collector body 210.

Figure 4A:
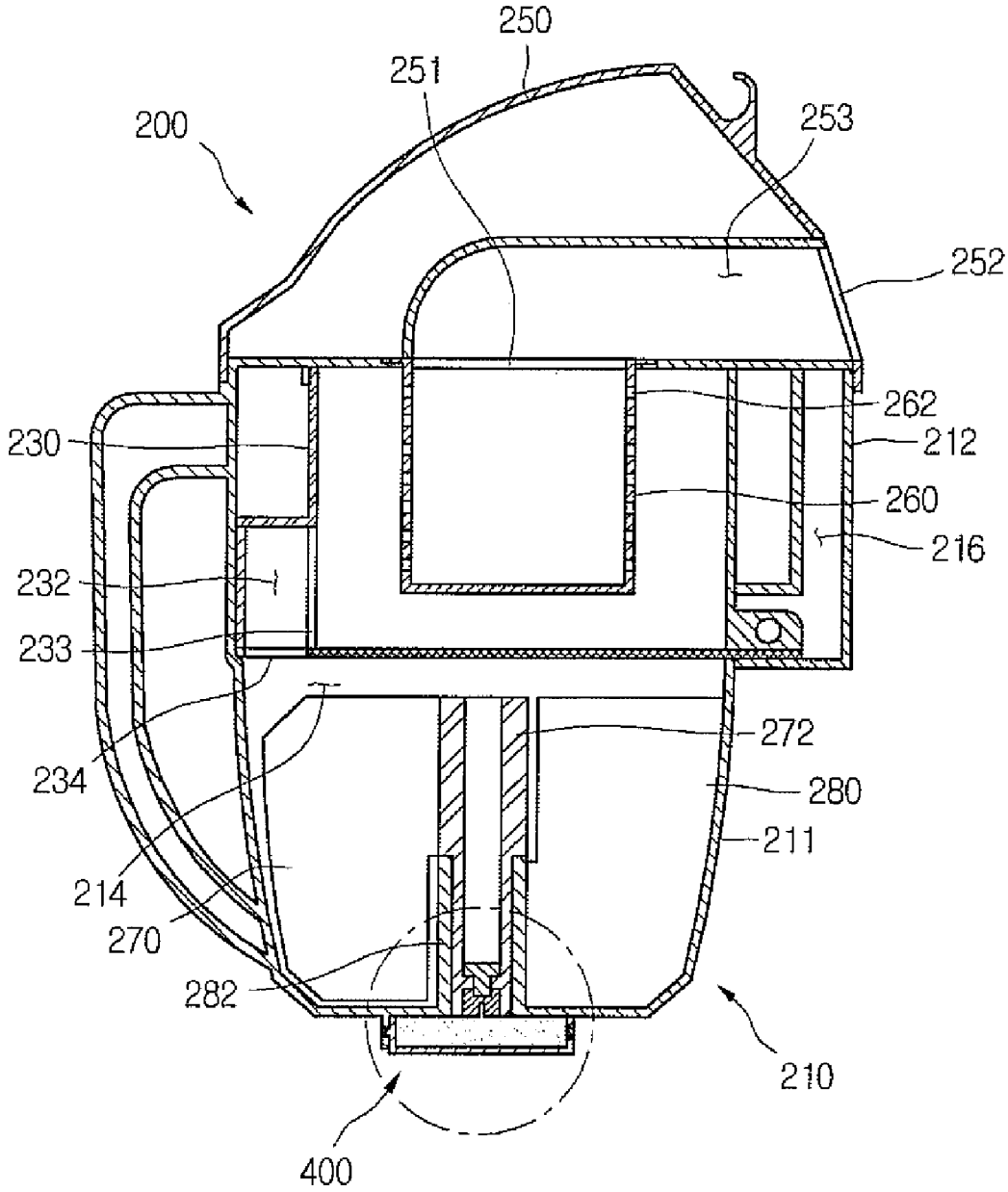
FIG. 4 is a cross-sectional view taken along I-I' of FIG. 3.
Figure 4B:
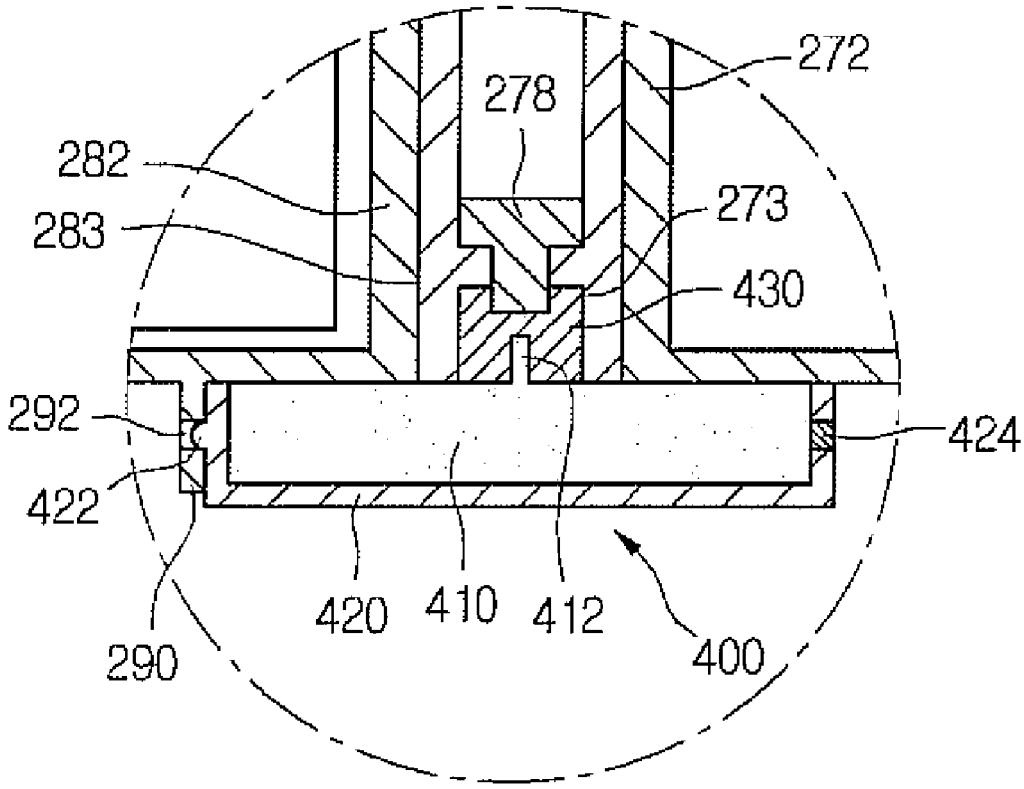
Figure 5:
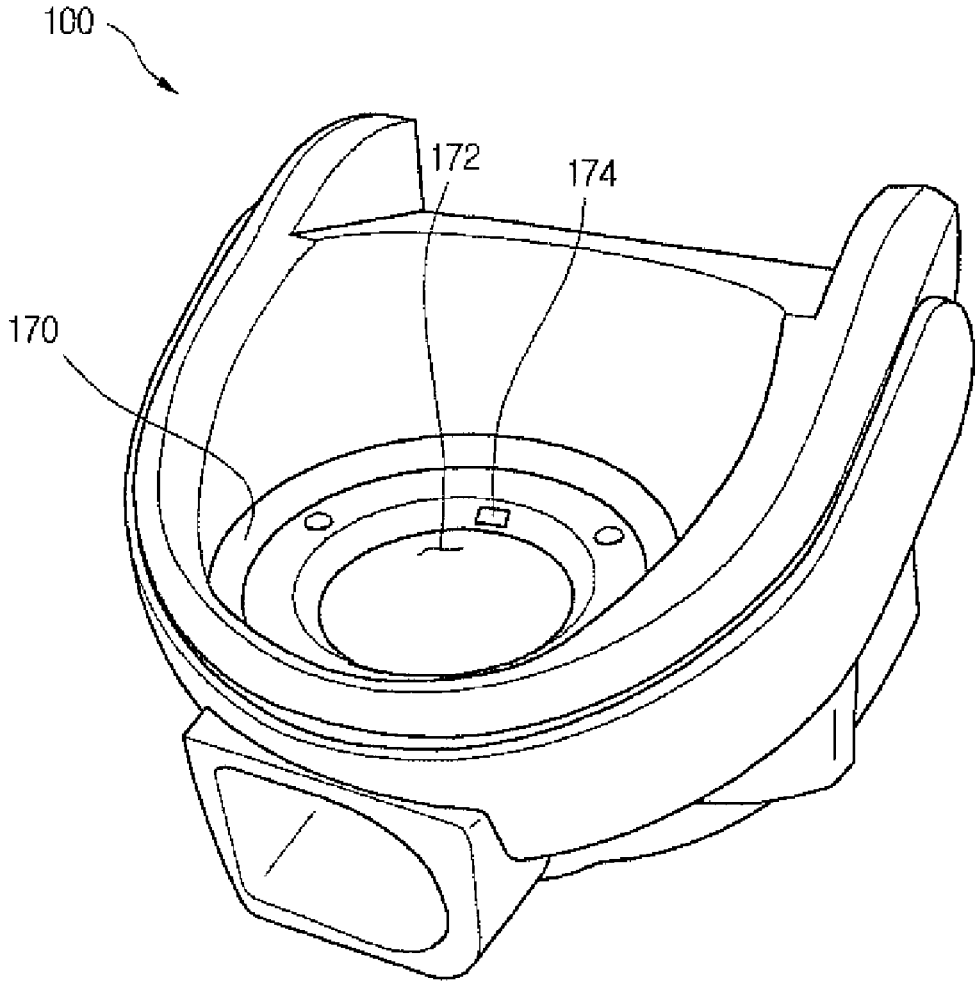
FIG. 5 is a lower perspective view of the dust collector of the vacuum cleaner of FIGS. 1-2.
Figure 6:
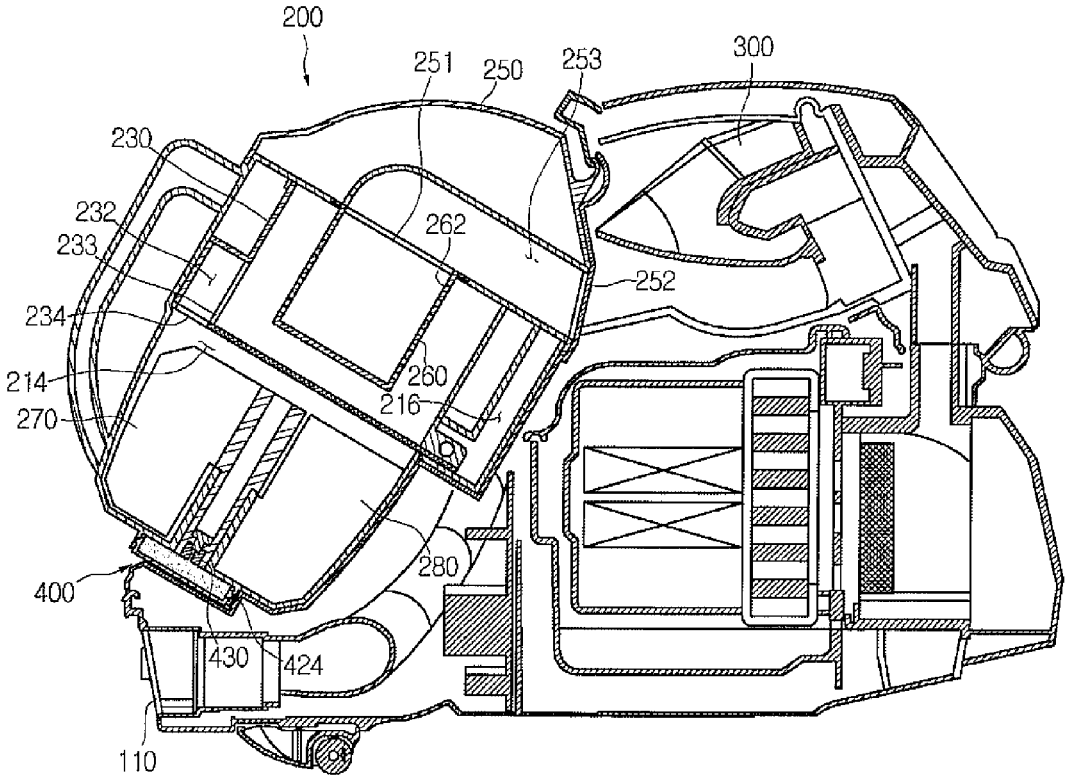
FIG. 6 is a perspective view of a driven gear of the vacuum cleaner of FIGS. 1-2.
Figure 7:
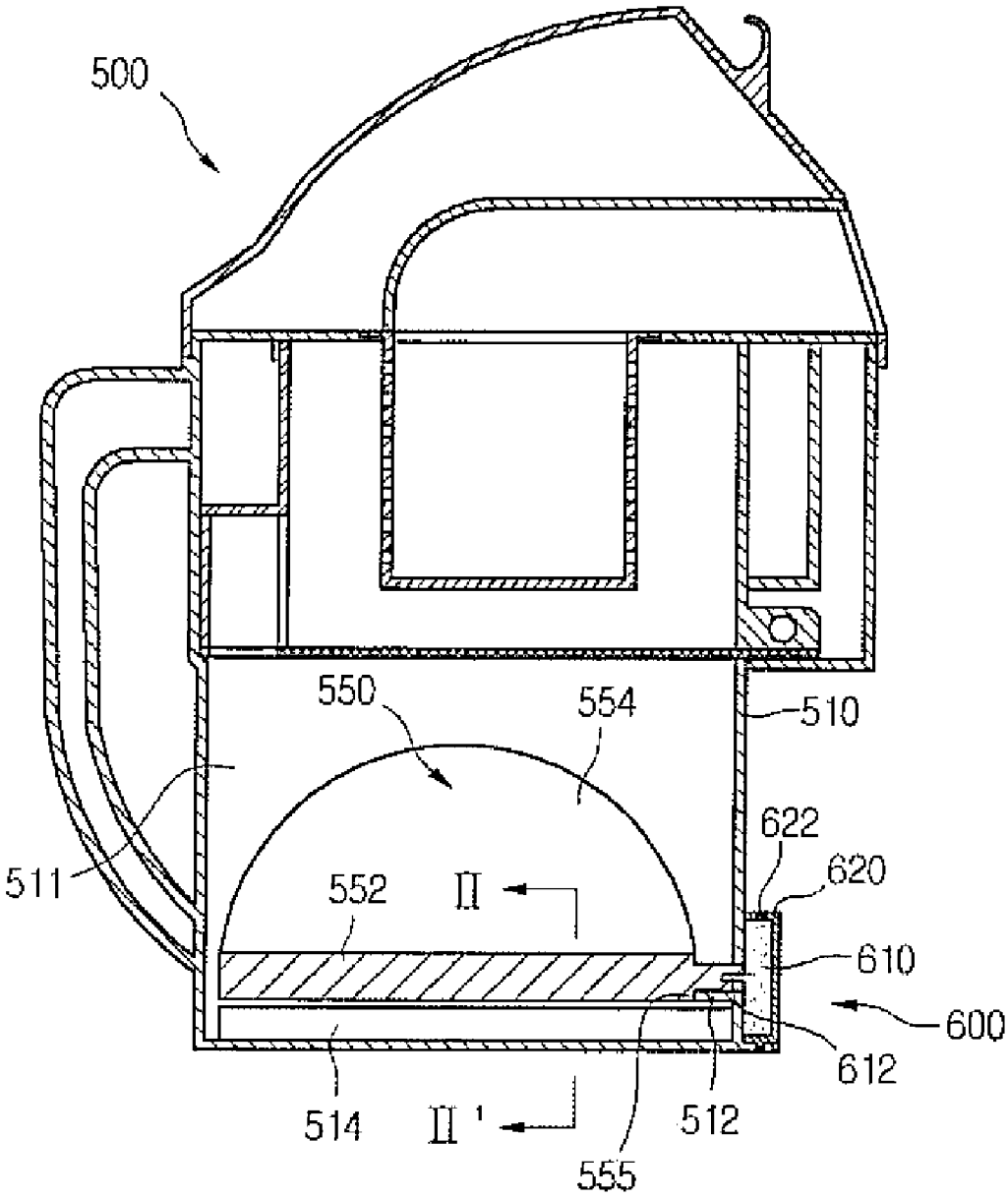
FIG. 7 is a perspective view of a dust collector mounting element of the vacuum cleaner of FIGS. 1-2.

A structure for reducing the volume of the dust stored in the dust collector 200 may be provided in the dust collector 200. FIG. 4 is a cross-sectional view taken along I-I' of FIG. 3. FIG. 5 is a lower perspective view of the dust collector of the vacuum cleaner of FIGS. 1-2. FIG. 6 is a perspective view of a driven gear of the vacuum cleaner of FIGS. 1-2. FIG. 7 is a perspective view of a dust collector mounting element of the vacuum cleaner of FIGS. 1-2.

Referring to FIG. 4, the dust collector 200 according to this embodiment may include the dust collector body 210 that defines an external appearance, the primary cyclone device 230 provided in the dust collector body 210 to separate dust from air, and a cover element 250 that selectively opens or closes an upper part of the dust collector body 210.

A dust container in which the separated dust may be stored is formed in the dust collector body 210. The dust container may include a first dust container 214, in which the dust separated by the primary cyclone device 230 may be stored, and a second dust container 216, in which the dust separated by the secondary cyclone device 300 may be stored.

The dust collector body 210 may include a first wall 211 that defines the first dust container 214, and a second wall 212 that defines the second dust container 216 in relation to the first wall 211. That is, the second wall 212 may be formed to surround an external portion of the first wall 211. Therefore, the second dust container 216 may be formed outside of the first dust container 214.

In the primary cyclone device 230, a dust guide channel 232 that guides the dust separated from air into the first dust container 214 may be provided. An inlet 233 of the dust guide channel 232 may be formed at a side of the primary cyclone device 230, and an outlet 234 may be formed at a bottom of the primary cyclone device 230.

The cover element 250 may be detachably connected to a top of the dust collecting body 210, as described above. The cover element 250 may open or close the first and second containers 214, 216 at the same time. The primary cyclone device 230 may be connected to a lower part of the cover element 250.

A discharge hole 251, through which the air separated from the dust in the primary cyclone device 230 may be passed, may be formed in a lower surface of the cover element 250. A filter element 260, in which a plurality of perforated-holes 262 of a specific size may be formed in a circumferential surface thereof, may be connected to a lower surface of the cover element 250.

Also, a channel 253 that guides the air of the primary cyclone device 230 discharged from the discharge hole 251 to the first air outlet 252 may be formed in the cover element 250. The channel 253 may serve as a passage connecting the discharge hole 251 with the first air outlet 252.

A pair of pressing elements 270, 280 that increase a dust-collecting capacity by reducing a volume of dust stored in the first dust container 214 may be provided in the dust collector body 210. The pair of pressing elements 270, 280 may reduce the volume of dust by compressing the dust by reciprocal action of the pressing elements. Therefore, the dust-collecting capacity of the dust collector 200 may be increased by increasing the density of the dust stored in the dust collector body 210. Hereinafter, for convenience of explanation, one of the pair of pressing elements 270, 280 may be referred to as a first pressing element 270, and the other may be referred to as a second pressing element 280.

According to this embodiment, at least one of the pair of pressing elements 270, 280 may be movably provided in the dust collector 200, so that the dust may be compressed between the pair of pressing elements 270, 280. That is, if the first and second pressing elements 270, 280 are rotatably provided in the dust collector 200, a distance between one side of the first pressing element 270 and one side of second pressing element 280, which is opposite to the one side of the first pressing element 270, may be decreased as the first and second pressing elements 270, 280 are rotated to each other. Therefore, the dust disposed between the pair of pressing elements 270, 280 may be compressed.

However, according to this embodiment, the first pressing element 270 may be rotatably provided in the dust collector body 210 and the second pressing element 280 may be fixedly provided in the dust collector body 210. Therefore, the first pressing element 270 may be a rotating element, and the second pressing element 280 may be a fixed element.

More particularly, the second pressing element 280 may be disposed between an inner circumferential surface of the dust collector body 210 and an axial line of a rotational axis 272, which is a center of rotation of the first pressing element 270. That is, the second pressing element 280 may be provided on a surface connecting the axial line of the rotational axis 272 with the inner circumferential surface of the first dust container 214. The second pressing element 280 may fully or partially close a space between the inner circumferential surface of the first dust container 214 and the axial line of the rotational axis 272. Therefore, the second pressing element 280 and the first pressing element 270 may compress dust when the dust is moved by the first pressing element 270.

One end of the second pressing element 280 may be integrally formed with an inner circumferential surface of the dust collector body 210, and the other end may be integrally formed with a fixed axis 282, which may be the same axis as the rotational axis 272 of the first pressing element 270. Further, only one end of the second pressing element 280 may be integrally formed with the inner circumferential surface of the dust collector body 210, or only the other end may be integrally formed with the fixed axis 282. In other words, the second pressing element 280 may be fixed on at least one of the inner circumferential surface of the dust collecting body 210 or the fixed axis 282.

However, even if one end of the second pressing element 280 is not integrally formed with the inner circumferential surface of the dust collector body 210, the one end of the second pressing element 280 may be placed adjacent to the inner circumferential surface of the dust collector body 210.

Further, even if the other end is not integrally formed with the fixed axis 282, the other end may be placed adjacent to the fixed axis 282. This prevents the dust introduced by the first pressing element 270 from leaking through a gap between the second pressing element 280 and the inner circumferential surface of the dust collector body 210.

The first and second pressing elements 270, 280 may include a plate having a rectangular shape. The rotational axis 272 of the first pressing element 270 may be positioned along the same axis as an axial line constituting a center of the dust collector body 210.

The fixed axis 282 may protrude upwardly from a lower surface of the dust collector body 210, and a hollow hole 283 that passes in an axial direction for connection of the rotational axis 272 may be formed in the fixed axis 282. A portion of the rotational axis 272 may be inserted into the hollow hole 283 from the upper part of the fixed axis 282.

A step 272*c*, which is supported by a top of the fixed axis 282, may be formed on the rotational axis 272. The rotational axis 272 may be divided into an upper axis 272*a*, to which the first pressing element 270 may be connected, and a lower axis 272*b*, to which a driven gear that rotates the first pressing element 270 may be connected, with reference to the step 272*c*.

The vacuum cleaner according to this embodiment may further include a driving device selectively connected to the first pressing element 270 to rotate the first pressing element 270.

Hereinafter, a relationship between the dust collector 200 and the driving device will be explained in detail with reference to FIGS. 5 to 7. Referring to FIGS. 5 to 7, the driving device that rotates the first pressing element 270 may include a compression motor 570 that generates a driving force, and a power transmission device that transmits the driving force of the compression motor 570 to the first pressing element 270.

More particularly, the power transmission device may include a driven gear 410 connected to the rotational axis 272 of the first pressing element 270, and a driving gear 420 that transmits power from the compression motor 570 to the driven gear 410. The driving gear 420 may be rotated by the compression motor 570, as it may be connected to the rotational axis of the compression motor 570.

Therefore, if the compression motor 570 is rotated, the driving gear 420 connected with the compression motor 570 is rotated, and thus, the driven gear 410 is rotated because the rotational force of the compression motor 570 is transmitted to the driven gear 410 by the driving gear 420. The first pressing element 270 may be rotated by the rotation of the driven gear 410.

An axis 414 of the driven gear 410 may be connected with the rotational axis 272 of the first pressing element 270 at a lower part of the dust collector body 210. As described above, the driven gear 410 may be exposed to the outside of the dust collector body 210.

The compression motor 570 may be provided below the dust collector mounting element 170, and the driving gear 420 may be provided at a bottom of the dust collector mounting element 170, as it may be connected to a rotational axis of the compression motor 570. Further, some of an outer circumferential surface of the driving gear 420 may be exposed at the bottom of the dust collector mounting element 170. An opening 173 that exposes some of the driving gear 420 may be formed in the dust collector mounting element 170. As the driven gear 410 is exposed in the dust collector mounting element 170, if the dust collector 200 is mounted on the dust collector mounting element 170, then the driven gear 410 may engage with the driving gear 420.

The compression motor 570 may rotate in forward and reverse directions. In other words, a motor capable of rotating bi-directionally may be used as the compression motor.

The first pressing element 270 may rotate in forward and reverse directions, and the compressed dust may be accumulated on both sides of the second pressing element 280 as the first pressing element 270 rotates in the forward and reverse directions. In order to allow the forward/reverse rotation of the compression motor, a synchronous motor may be used as the compression motor.

The synchronous motor may be configured such that the forward/reverse rotation may be enabled by the motor itself. That is, if the force exerted on the motor is greater than a set value when the motor rotates in one direction, then the motor rotates in the other direction. The force exerted on the motor may be a resisting force (torque), which may be created as the first pressing element 270 presses the dust. The rotational direction of the motor may be changed when the resisting force reaches the set value. Synchronous motors are generally known in the art, and thus, detailed explanation has been omitted.

Further, the first pressing element 270 may continuously press the dust for a predetermined period of time, even when the first pressing element 270 reaches a stationary point where no more rotation is possible, as it compresses the dust due to the rotation. The stationary point, where the first pressing element 270 cannot rotate any more, may correspond to the case in which the resisting force reaches the set value.

Further, if the resisting force reaches the set value, then the power rotating the first pressing element, that is, the power source applied to the compression motor, may be turned off for a predetermined period of time. Thus, the first pressing element 270 may keep pressing the dust, and the first pressing element 270 may be able to move by applying the power to the compression motor 570 after the predetermined period of time elapses. Since the cut off time of the power applied to the compression motor may be the time that the resisting force reaches the set value, if the compression motor 570 is driven again, then the rotational direction of the compression motor 570 is opposite to the rotational direction of the compression motor 570 before the power was cut off. In order to easily compress the dust, the compression motor 570 may continually rotate the first pressing element 270 in the forward and reverse directions at the same angular velocity.

A guide rib 290 that guides installation of the dust collector 200 may be formed in the lower part of the dust collector body 210, and an insert groove 172, in which the guide rib 290 may be inserted, may be formed in the dust collector mounting element 170.

The guide rib 290 may be provided at an outside of the driven gear 410 in the shape of "C" Therefore, the guide rib 290 may protect the driven gear 410 and prevent dust from getting onto the driven gear 410.

The driven gear 410 may include a body 412, and a plurality of gear teeth 416 formed along a side surface of the body 412. A magnetic element 415 may be provided in the body 412. More particularly, the magnetic element 415 may extend from a center of the body 412 to an edge of the body 412 in a radial direction.

Further, a plurality of magnetic sensors that detect magnetism of the magnetic element 415 may be provided on an inner side of the dust collector mounting element 170. The magnetic sensors may include a first magnetic sensor 440 that detects installation of the dust collector 200, and a second magnetic sensor 450 that detects a state of rotation of the driven gear 410.

Further, the first magnetic sensor 440 may be provided at a center of the insert groove 172 to detect magnetism of an A portion of the magnetic element 415. The second magnetic sensor 450 may be placed apart from the first magnetic sensor 440 and may detect magnetism of a B portion of the magnetic element 415. The dust collector 200 may be mounted on the dust collector mounting element 170 and may be disposed vertically below a trajectory of the magnetic element 415 when the driven gear 410 is rotated, so that the second magnetic sensor 450 may effectively detect magnetism generated from the magnetic element 415. Therefore, the first magnetic sensor 440 may always detects magnetism when the dust collector 200 is mounted on the dust collector mounting element 170.

However, the second magnetic sensor 450 may detect magnetism only when the magnetic element 415 is disposed vertically above the second magnetic sensor 450 while the driven gear 410 is rotated. Therefore, it may be possible to check a rotational state of the driven gear 410.

One magnetic element may be provided in the driven gear according to this embodiment; however, it is also possible that a first magnetic element may be provided at the center of the driven gear and a second magnetic element may be provided at a position spaced apart from the first magnetic element. In such a case, the first magnetic sensor 440 may detect magnetism of the first magnetic element, and the second magnetic sensor 450 may detect magnetism of the second magnetic element.

Figure 8:
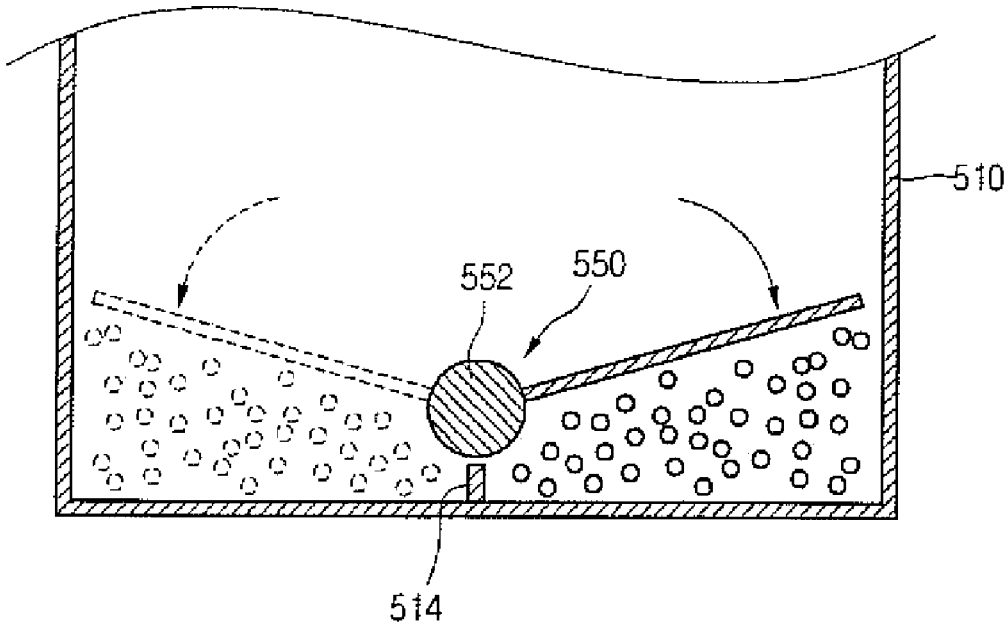
FIG. 8 is a block diagram showing a control structure of the vacuum cleaner of FIGS. 1-2.

FIG. 8 is a block diagram of a control structure of the vacuum cleaner of FIGS. 1-2. Referring to FIG. 8, the vacuum cleaner according to this embodiment may include a controller 510, an operation signal input device 520 that selects the suction power (for example, high, medium and low modes) for dust, a signal display 530 that displays an empty signal regarding dust stored in the dust collector 200 and a dust collector uninstallation signal, a suction motor driver 540 that operates a suction motor according to the operation mode input from the operation signal input device 520, and a compression motor driver 560 that operates a compression motor 570, which is used to compress dust stored in the dust collector 200. The vacuum cleaner may further include a driving gear 420 driven by the compression motor 570, a driven gear 410 rotated by engagement with the driving gear 420, a magnetic element 415 provided in the driven gear 410, a first magnetic sensor 440, and a second magnetic sensor 450.

If the dust collector 200 is not mounted on the dust collector mounting element 170, then magnetism of the magnetic element 415 may not be detected by the first magnetic sensor 440. Therefore, if the operation signal is input from the operation signal input device 520 while the dust collector 200 is not mounted on the dust collector mounting element 170, then the dust collector uninstallation signal may be displayed.

Further, the controller 510 may determine an amount of dust stored in the dust collector 200 with reference to the rotational state of the driven gear 410, which is detected by the second magnetic sensor 450. If the controller 510 determines that the amount of dust is greater than a specific value, then the dust empty signal may be displayed at or on the signal display 530. Since the driven gear 410 and the first pressing element 270 may be connected, the rotational state of the driven gear 410 may be found by checking the rotation position of the first pressing element 270. The first magnetic sensor 440 may be referred to as a "dust collector sensor", because it detects the mounting of the dust collector 200, while the second magnetic sensor 450 may be referred to as a "position sensor," because it detects the position of the first pressing element 270.

The signal displayed at or on the signal display 530 may be a sound signal, a visual signal, or a vibration directly transmitted to users. A speaker, a LED, or a vibration motor, for example, may be used as the signal display 530. Further, the signal displayed at or on the signal display 530 may be differently set for the dust empty signal and the dust collector uninstallation signal.

Figure 9:
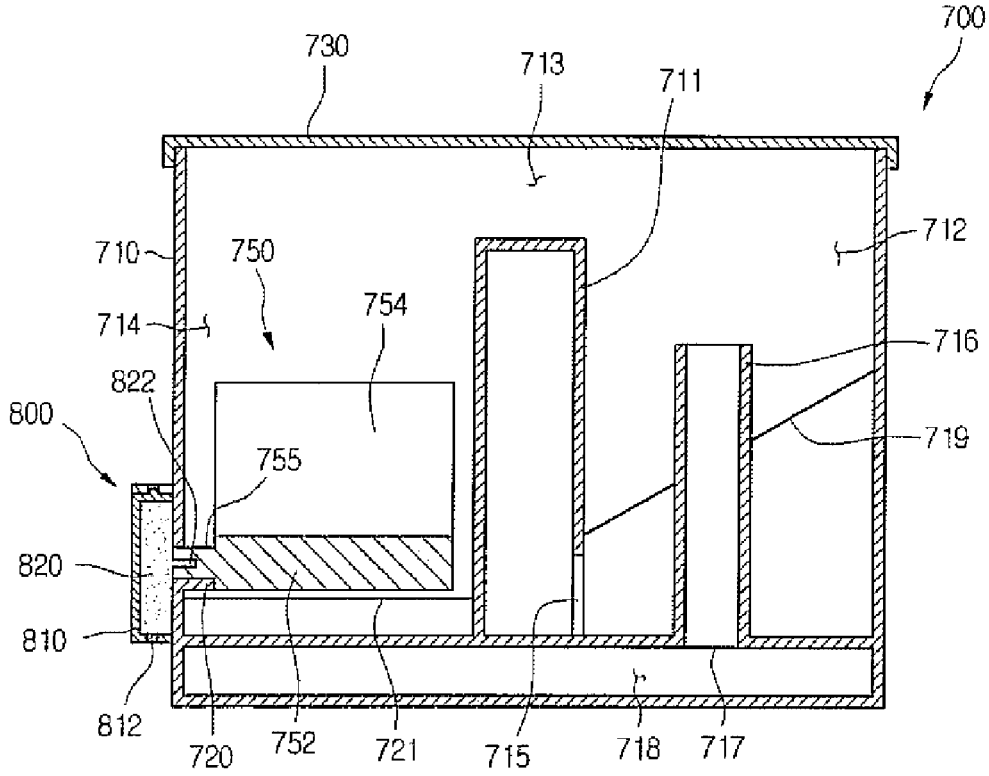
FIGS. 9 and 10 are views showing a position relationship between a magnetic element and a second magnetic sensor when a first pressing element is placed adjacent to one side of a second pressing element.
Figure 10:
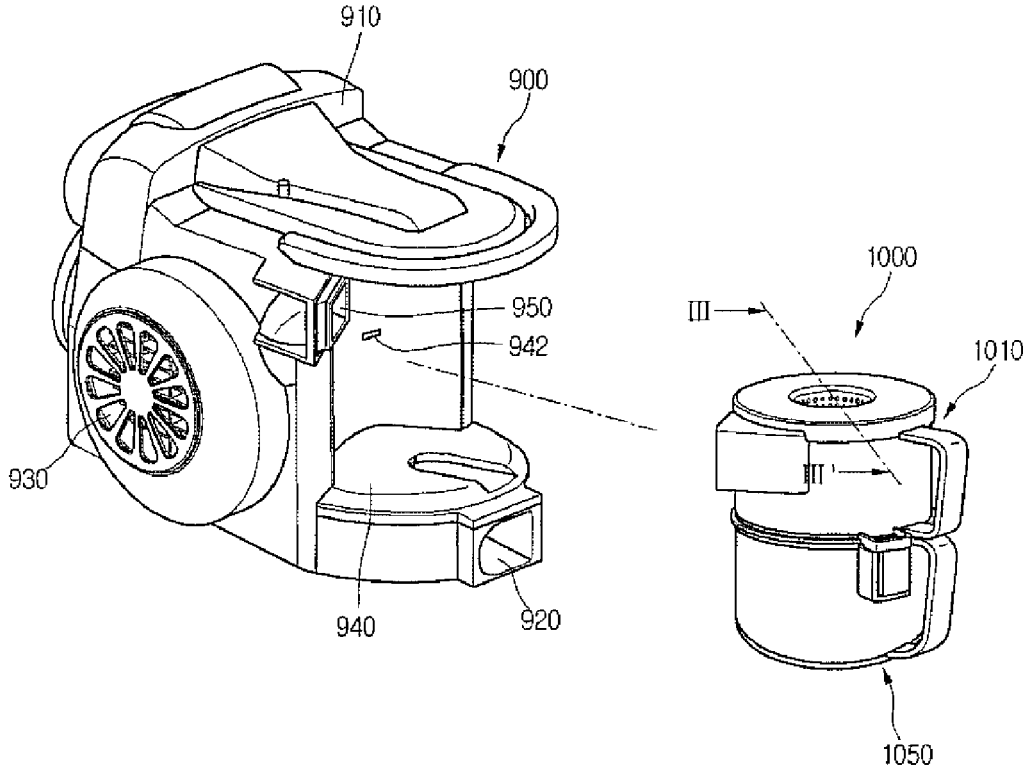
Figure 11:
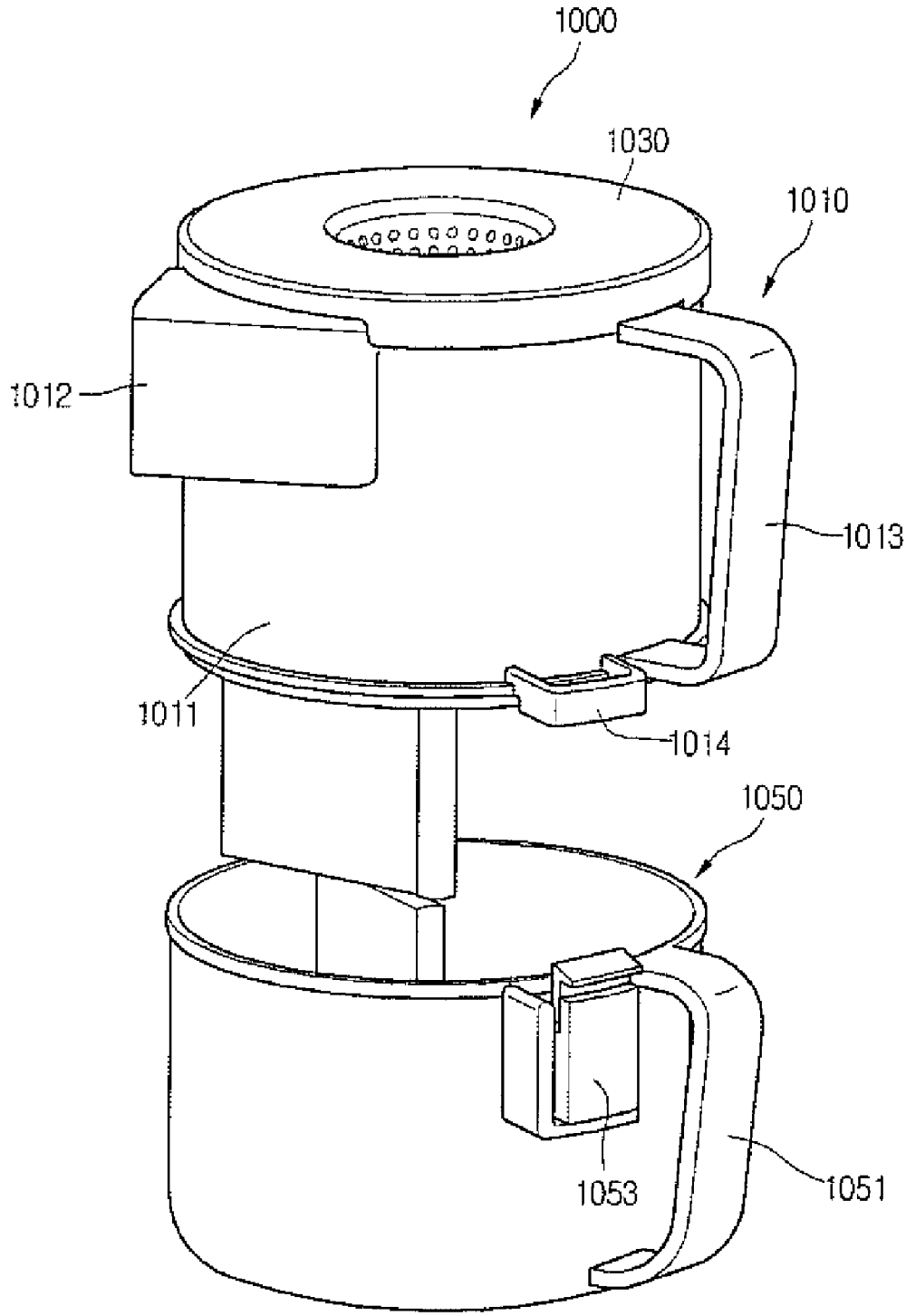
FIGS. 11 and 12 are views showing a position relationship between the magnetic element and the second magnetic sensor when the first and second pressing elements are oriented substantially in a straight line.
Figure 12:
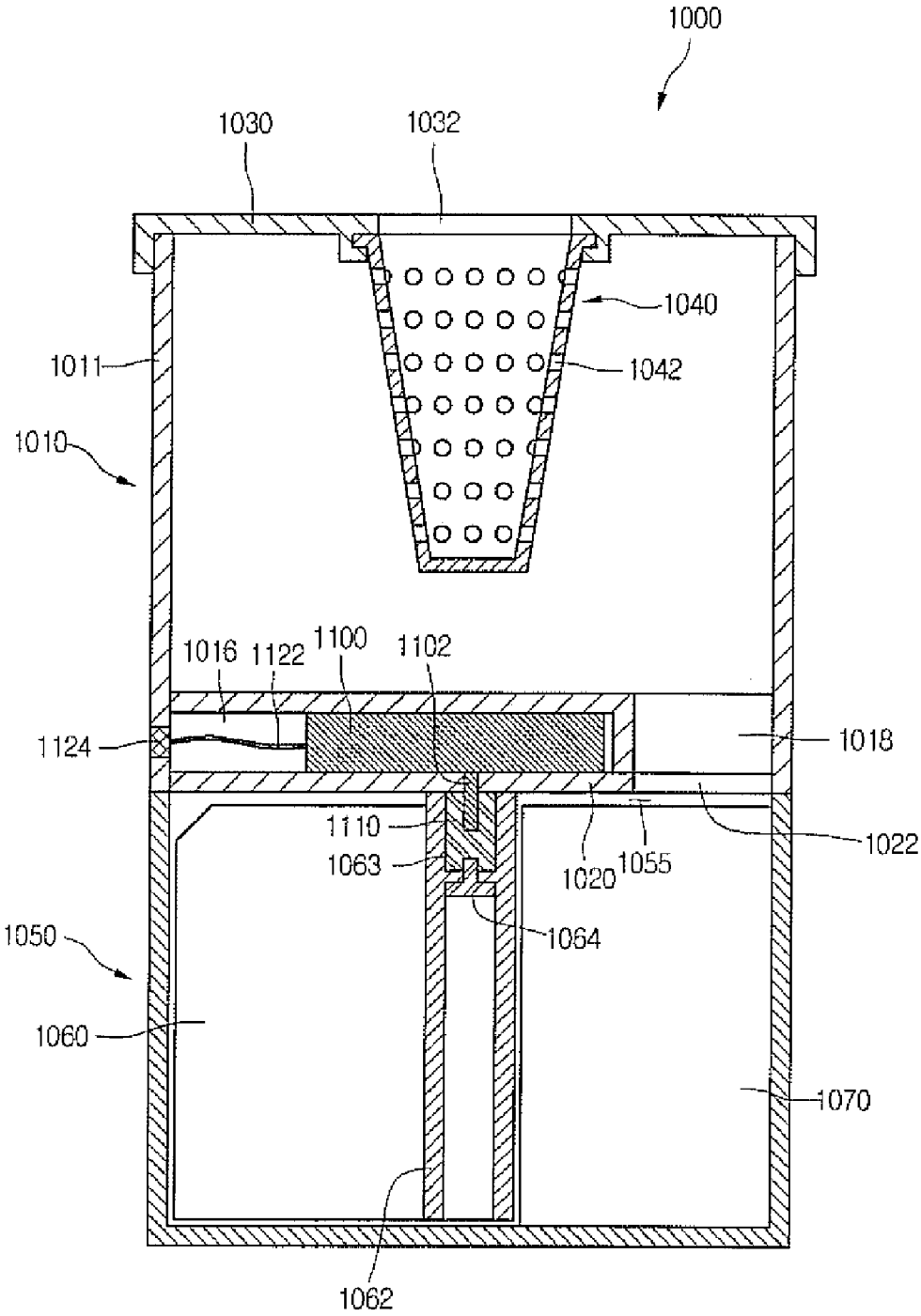
Figure 13:
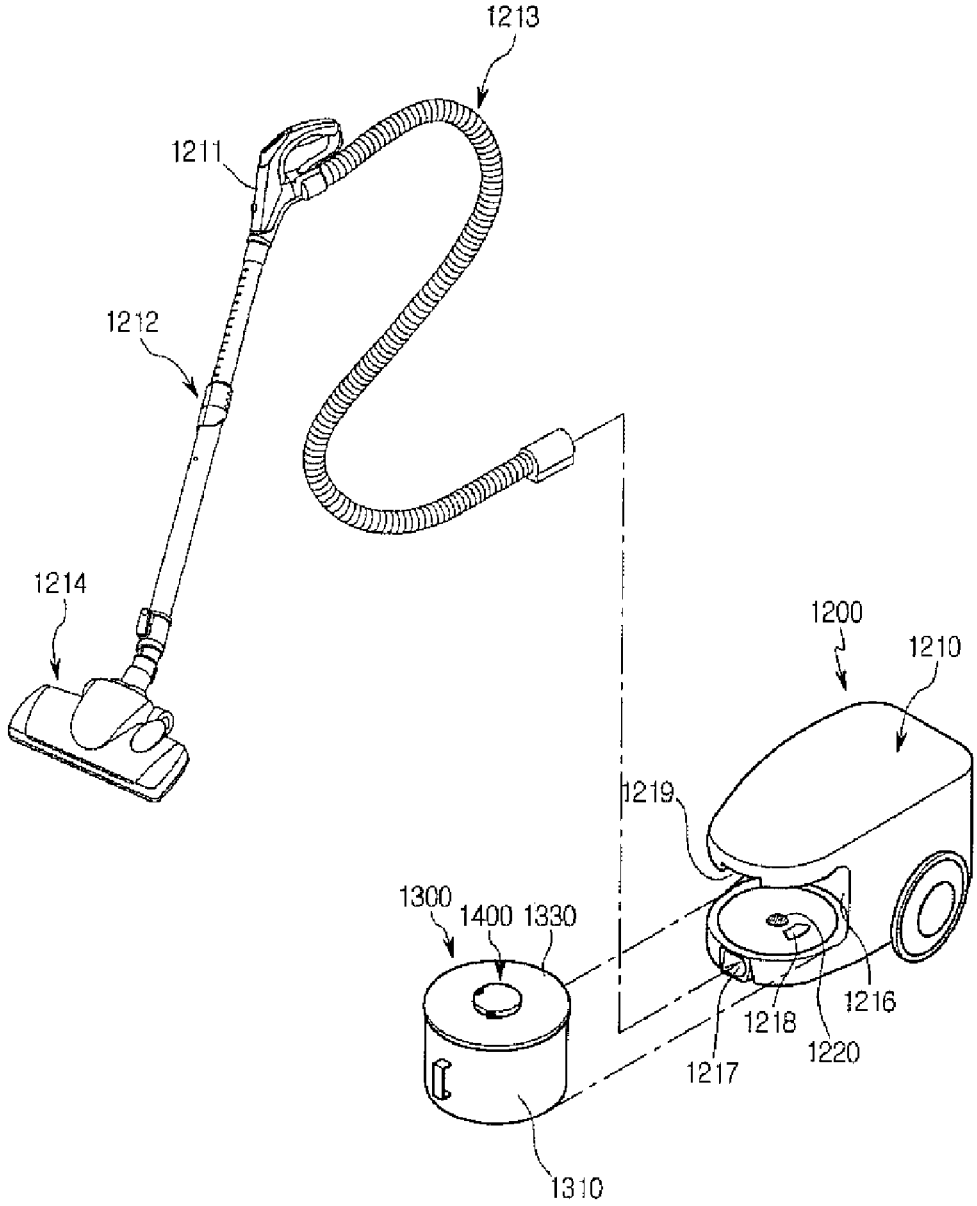
FIGS. 13 and 14 are views showing a position relationship between the magnetic element and the second magnetic sensor when the first pressing element is placed adjacent to the other side of the second pressing element.
Figure 14:
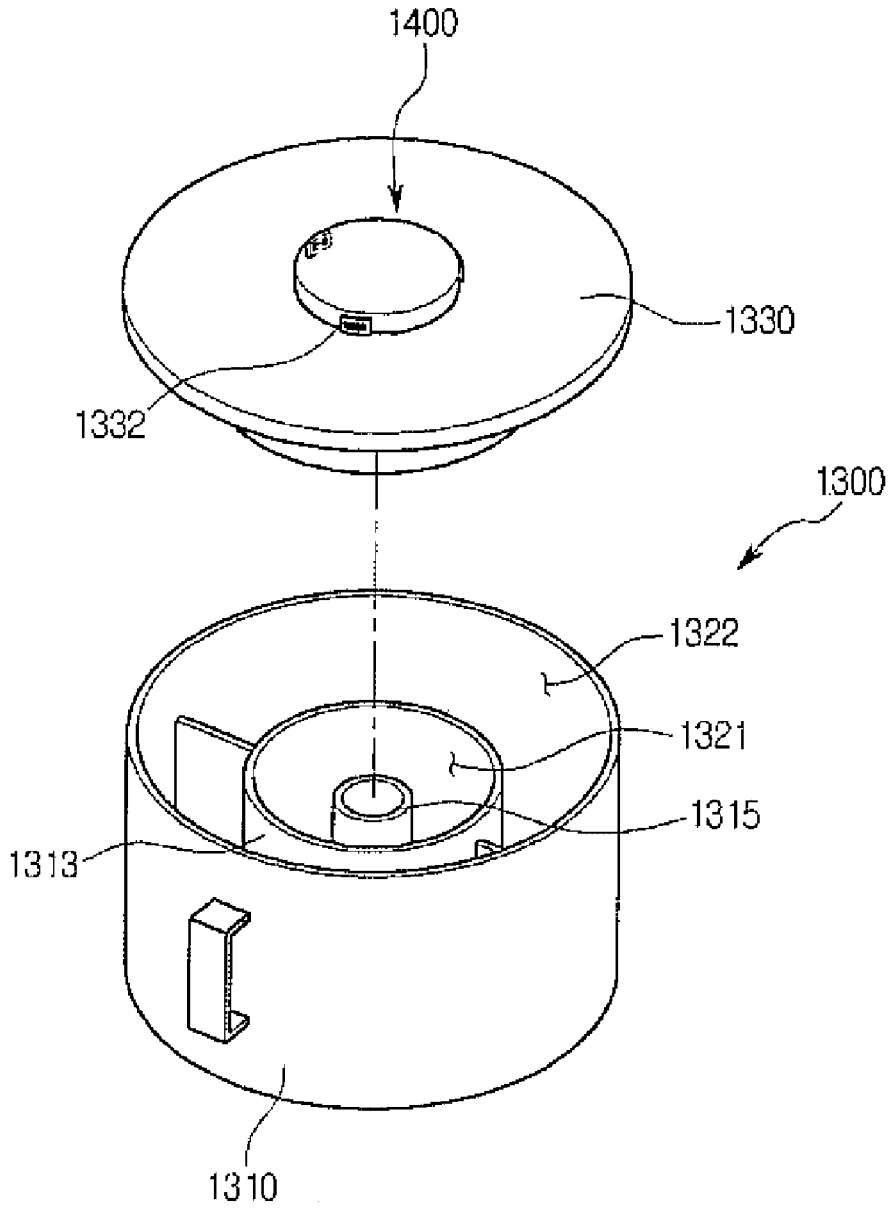

FIGS. 9 and 10 show a position relationship between a magnetic element and a second magnetic sensor when a first pressing element is placed adjacent to one side of a second pressing element. FIGS. 11 and 12 show a position relationship between the magnetic element and the second magnetic sensor when the first and second pressing elements are oriented substantially in a straight line. FIGS. 13 and 14 show a position relationship between the magnetic element and the second magnetic sensor when the first pressing element is placed adjacent to the other side of the second pressing element.

As shown in FIGS. 9 to 14, according to an embodiment, when the first and second pressing elements are oriented substantially in a straight line as the first pressing element 270 is rotated approximately 180 degree, the magnetic element 415 may be positioned vertically above the second magnetic sensor 450, and thus, the second magnetic sensor 450 may detect magnetism of the magnetic element 415. The position of the first pressing element 270, where the second magnetic sensor 450 detects magnetism of the magnetic element 415, may be referred to as a "reference position."

Further, while the first pressing element 270 presses dust accumulated in the dust collector 200 as it rotates in a counter-clockwise direction, the magnetic element 415 may be spaced apart from the second magnetic sensor 450, and therefore, magnetism may not be detected by the second magnetic sensor 450. Additionally, if the first pressing element 270, which rotates in a counter-clockwise direction, is not further rotated, then the first pressing element 270 may start to rotate in a clockwise direction. Therefore, the first pressing element 270 may press dust accumulated in the dust collector 200, as it rotates to the right of the second pressing element 280, as in FIG. 13, by passing through the reference point in FIG. 11.

Further, if the first pressing element 270, which rotates in a clockwise direction, is not further rotated, then the first pressing element 270 may start to rotate in a counter-clockwise direction. Therefore, the first pressing element 270 may press dust accumulated in the dust collector 200 by repeating the above-mentioned process.

Figure 15:
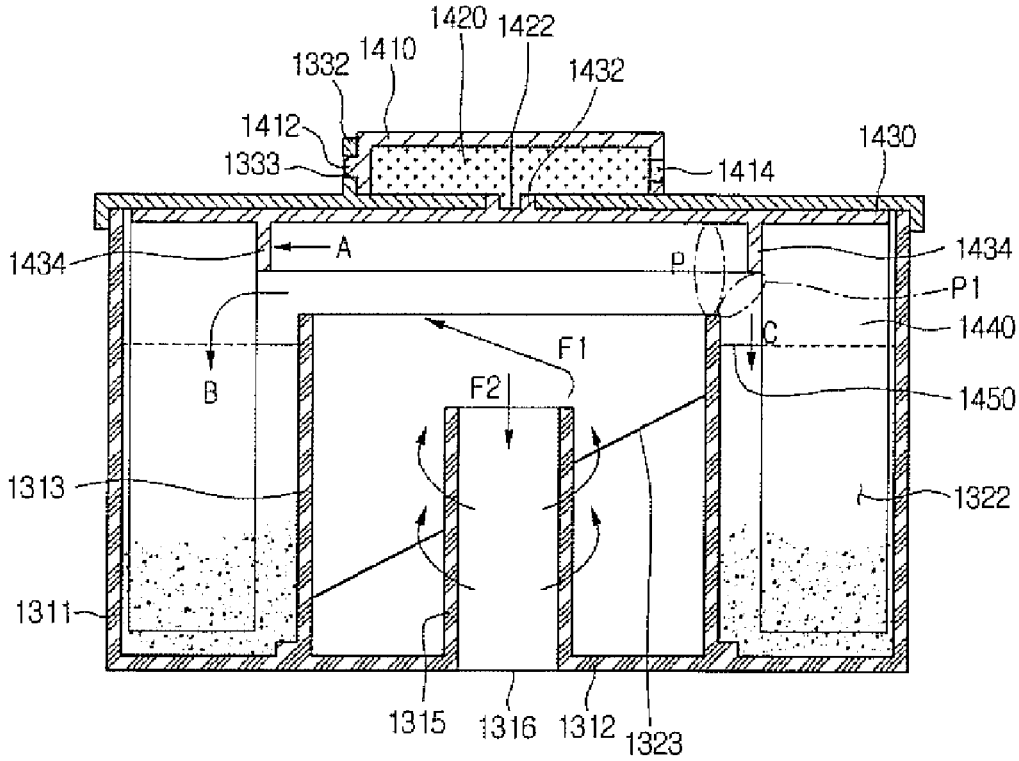
FIG. 15 is a view illustrating a rotational operation of the first pressing element of FIGS. 9 to 14.

FIG. 15 illustrates a rotational operation of the first pressing element of FIGS. 9 to 14. Referring to FIG. 15, a time TD1 required for the first pressing element 270 to return to the reference position from the reference position by rotating in a clockwise direction, and a time TD2 required for the first pressing element 270 to return to the reference position from the reference position by rotating in a counter-clockwise direction may be displayed. The time TD1 may be referred to as a "first turnaround", and the time TD2 may be referred to as a "second turnaround." Generally, since dust may be evenly accumulated in the dust collector 200, the time TD1 and the time TD2 may be almost the same.

Further, as the amount of dust compressed by the first pressing element 270 increases, the time TD1 and the time TD2 get shorter. According to this embodiment, when one of the time TD1 and the time TD2 reaches a specific reference time, it may be determined that dust is sufficiently accumulated in the dust collector 200, and therefore, the dust empty signal may be displayed.

Hereinafter, an operation of the vacuum cleaner and a compression process for dust according to an embodiment will be explained.

Figure 16:
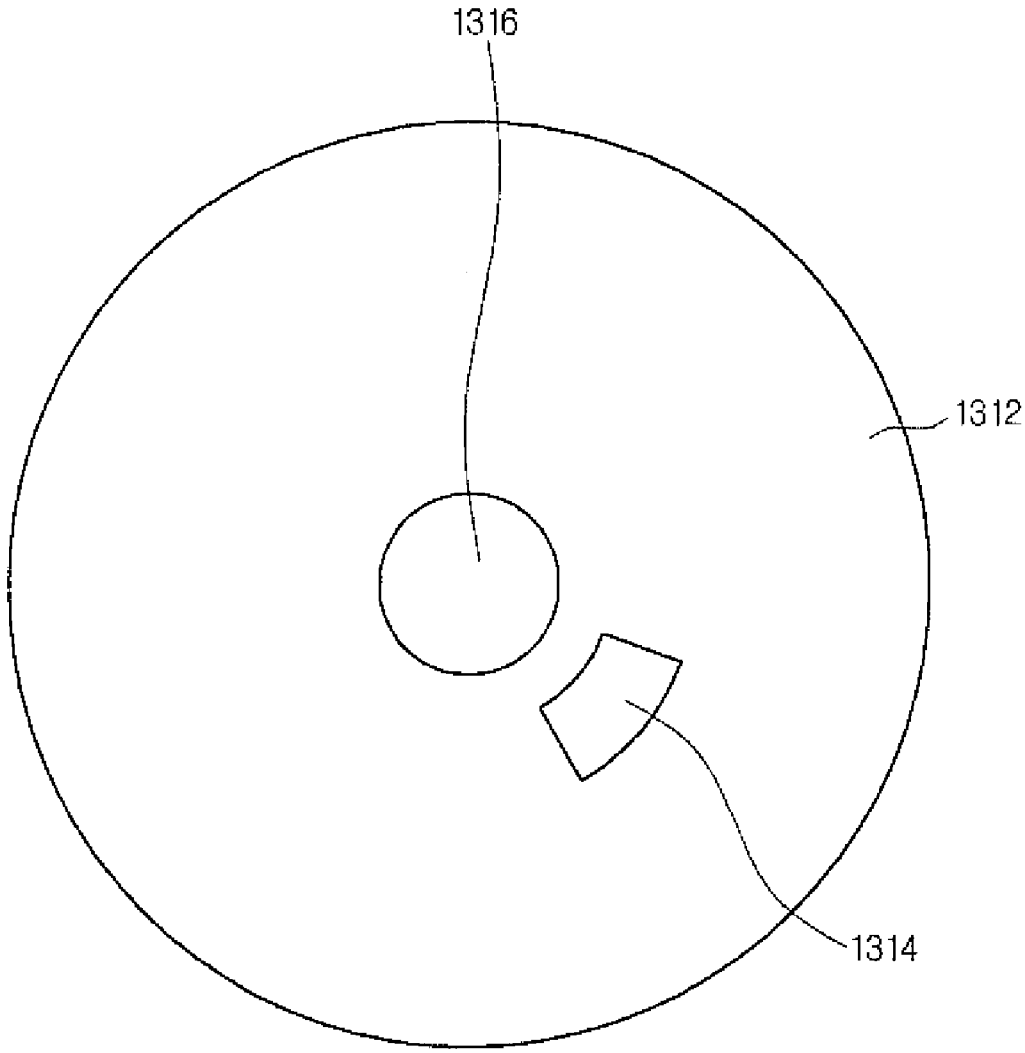
FIG. 16 is a flow chart of a control method of the vacuum cleaner of FIGS. 1-2.

FIG. 16 is a flow chart of a control method of the vacuum cleaner according to an embodiment. Referring to FIG. 16, it may be determined whether the suction motor operation signal is input through the operation signal input device 520 in a state in which the vacuum cleaner is deactivated, in step S10. When the suction motor operation signal is input, it may be determined whether the dust collector 200 is mounted or not, in step S11.

If magnetism of the magnetic element 415 is not detected by the first magnetic sensor 440, the signal indicating the dust collector is not mounted may be displayed at or on the signal display 530, in step S12. As described above, in a case in which the suction motor operation signal is input while the dust collector 200 is mounted, unnecessary operation of the suction motor and the compression motor may be prevented by informing a user of this state via the signal display 530.

However, if it is determined that the dust collector 200 is mounted because magnetism of the magnetic element 415 is detected by the first magnetic sensor 440, then the controller 510 may activate the suction motor driver 540, so that the suction motor 550 is activated according to the suction power selected by a user, in step S13. If the suction motor 550 is activated, then dust may be introduced through the suction nozzle by the suction force of the suction motor 550. The air sucked in through the suction nozzle may be introduced into the cleaner body 100 via the body intake port 110, and the introduced air may be introduced into the dust collector 200 via a predetermined channel.

Further, the air introduced into the dust collector 200 may be discharged to the cleaner body 100 after being filtered. The separated dust may be stored in the first dust container 214.

While dust is stored in the first dust container 214 after it is separated from the air, the pair of pressing element 270, 280 may press the dust stored in the first dust container 214. That is, the controller 510 may activate the compression motor 570 in order to compress the dust stored in the dust collector 200, in step S14.

According to this embodiment, the compression motor 570 may be driven after activating the suction motor 550. However, it may also be possible to activate the suction motor 550 and the compression motor 570 at the same time.

If the compression motor 570 is activated, the driving gear 420 connected with the rotational axis of the compression motor 570 may be rotated. If the driving gear 420 is rotated, the driven gear 410 may be rotated. If the driven gear 410 is rotated, the dust may be compressed as the first pressing element 270 connected with the driven gear 410 may be rotated to the second pressing element 280.

The controller 510 may initially determine whether the first pressing element 270 is positioned at the reference position, in step S15. According to this embodiment, since the first and second turnarounds may be measured with reference to the reference position, it is necessary to determine whether the first pressing element 270 is positioned at the reference position for the first movement.

The reference position of the first pressing element 270 may be checked when magnetism of the magnetic element 415 is initially detected by the second magnetic sensor 450 in the case of the first movement of the compression motor 570. Therefore, the controller 510 may measure the turnarounds of the first pressing element 270 with reference to a time when the second magnetic sensor 450 initially detects magnetism.

Further, the first and second turnarounds TD1, TD2 may be measured from the time when the first pressing element 270 moves to the reference position by rotating the first pressing element 270 in a clockwise or counter-clockwise direction, in step S16. As the amount of dust compressed by the first and second pressing elements in the dust collector 200 is increased, the rotation turnaround time period of the driven gear 410 may be reduced.

The controller 510 may determine the first and second turnarounds TD1 and TD2 of the first pressing element 270 by using the second magnetic sensor 450, and therefore, it may determine that the first and second turnarounds TD1 and TD2 reach the specific reference time, in step S17. The specific reference time may be set in the controller 510 by a designer. The reference time may be obtained by experiment, and may have different values according to a particular capacity of the vacuum cleaner.

According to this embodiment, when one of the time TD1 and the time TD2 reaches the reference time, the amount of dust may be determined to reach the specific amount. However, the amount of dust may be determined to reach the specific amount only when both of the time TD1 and the time TD2 reach the reference tune.

As a result of step S17, if any one of the time TD1 and the time TD2 is longer than the reference time, then the process may return to step S16 and accomplish the previous process. However, if the time TD1 or the time TD2 reaches the reference time, the dust empty signal of the dust collector 200 may be displayed at or on the signal display 530, in step S18.

Then, the controller 510 may turn off the suction motor 550 to prevent dust from being introduced therein, in step S19. That is, the suction motor 550 may be forcibly stopped, since the suction efficiency may be reduced and the suction motor 550 overloaded when the suction operation is continuously performed while the amount of dust accumulated in the dust collector 200 exceeds the specific amount. Further, the controller 510 may turn off the compression motor 570, in step S20.

According to this embodiment, unnecessary operation of the suction motor and the compression motor may be prevented by displaying the uninstallation signal of the dust collector 200, and convenience of a user may be increased because the dust empty time is known to the user.

Figure 17:
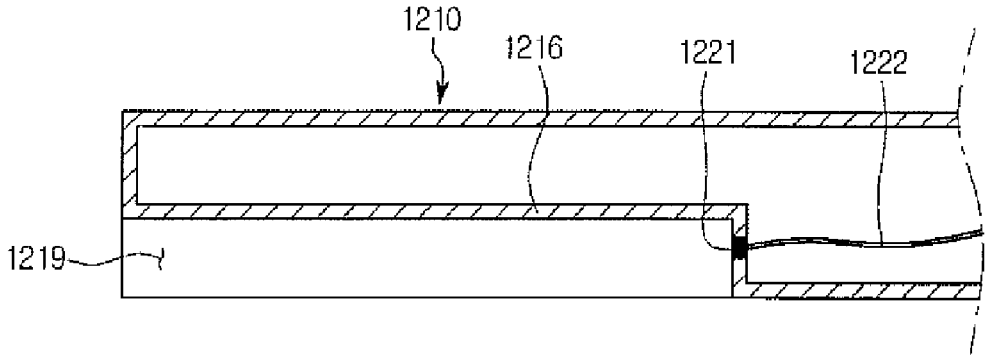
FIG. 17 is a lower perspective view of a driven gear according to another embodiment.
Figure 18:
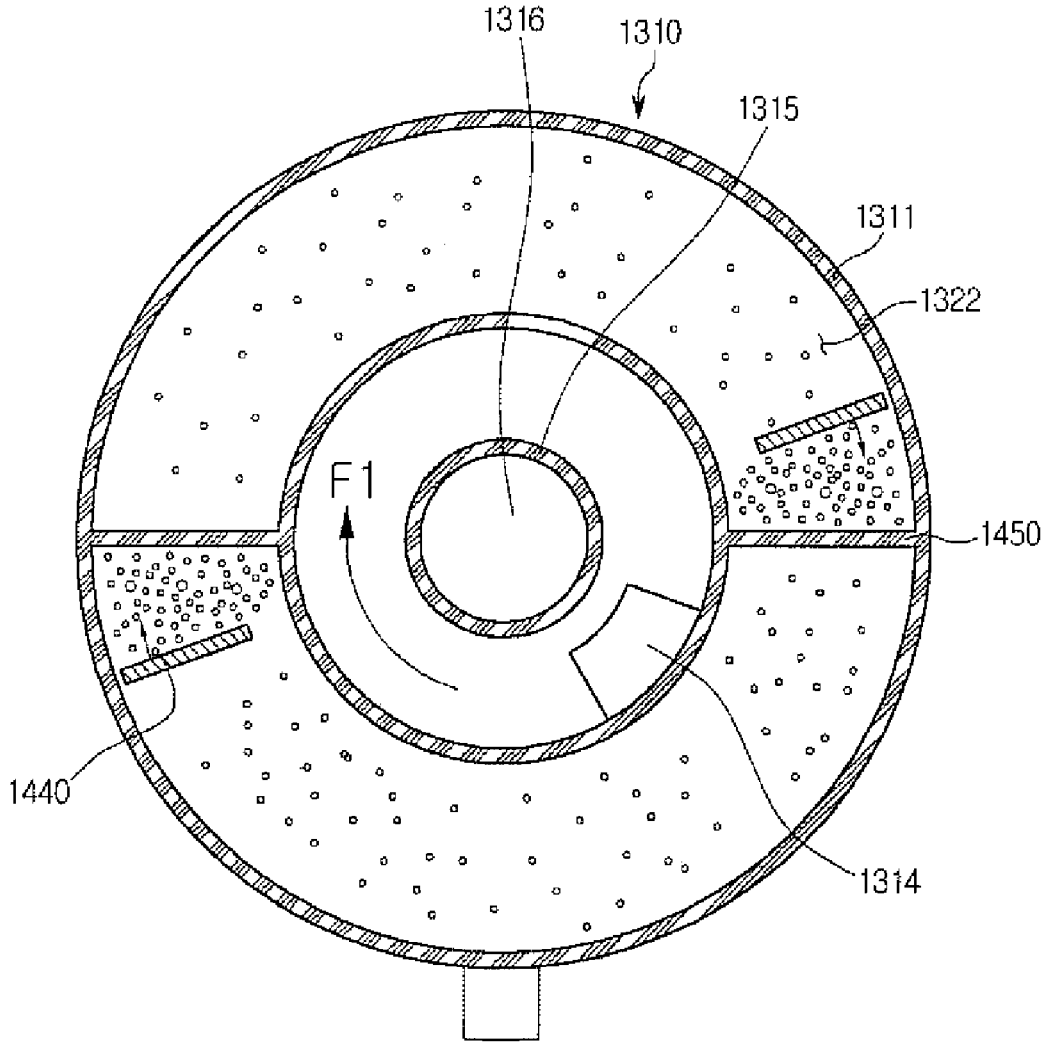
FIG. 18 is a perspective view of a dust collector mounting element according to another embodiment
Figure 19:
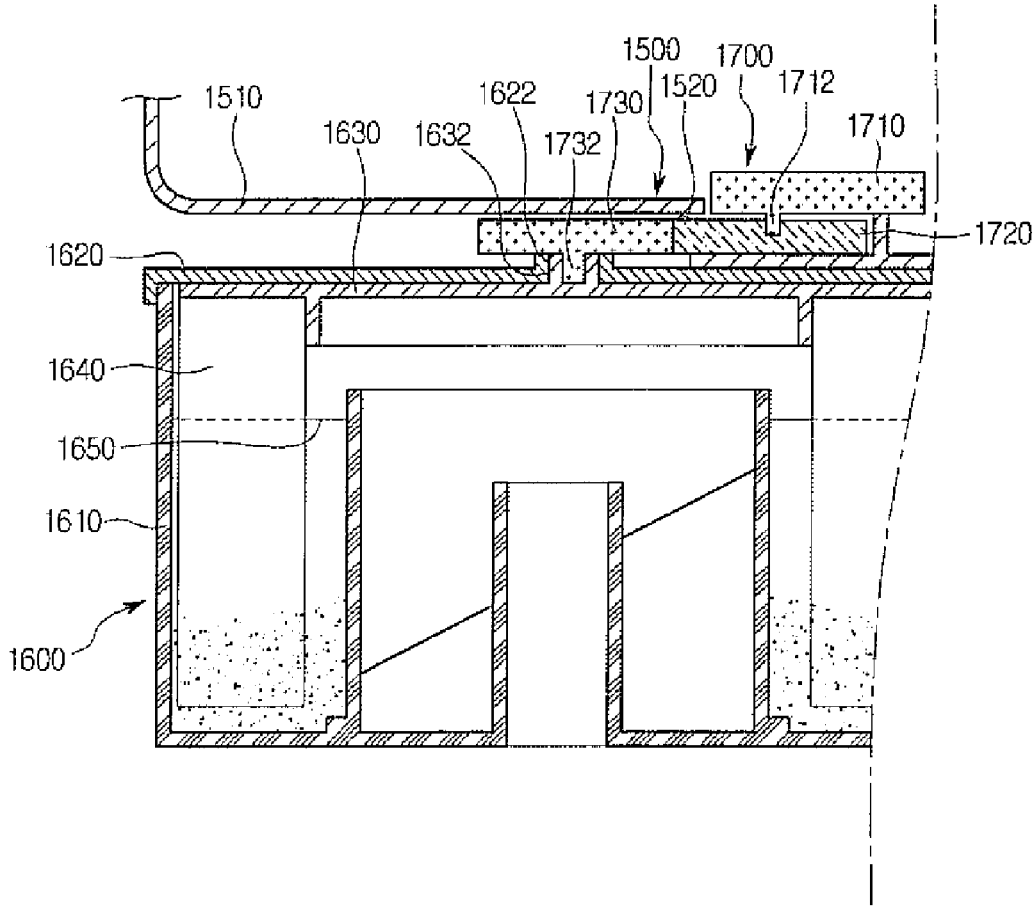
FIG. 19 is a view showing a position relationship between the driven gear of FIG. 17 and the installation sensor of FIG. 18.

FIG. 17 is a lower perspective view of a driven gear according to an embodiment. FIG. 18 is a perspective view of a dust collector mounting element according to the embodiment of FIG. 17. FIG. 19 shows a position relationship between the driven gear of FIG. 17 and the installation sensor of FIG. 18.

This embodiment is the same as the previous embodiment, except for a difference in the structure of detecting the installation of the dust collector. Therefore, repetitive description has been omitted.

Referring to FIGS. 17 to 19, installation of the dust collector according to this embodiment may be detected by a microswitch 640 provided in the dust collector mounting element 170, and a rotational position of a driven gear 610 may be detected by a magnetic sensor 630 provided in the dust collector mounting element 170. That is, the microswitch 640 may be a dust collector sensor that detects the installation of the dust collector, and the magnetic sensor 630 may be a position sensor that detects the position of the driven gear 610.

More particularly, the driven gear 610 may include a body 612, and a plurality of gear teeth 614 formed along a side surface of the body 612. A pressing element 616 may be formed in a bottom of the body 612. The pressing element 616 may be formed along a bottom edge of the body 612 and may downwardly protrude from the body 612. A magnetic element 620 may be provided in the body 612.

The microswitch 640 may be provided in the cleaner body 100. A terminal 650 connected with the microswitch 640 may be exposed to the outside of the dust collector mounting element 170. The pressing element 616 may press the terminal 650 when the dust collector is mounted on the dust collector mounting element 170. If the terminal 650 is pressed, the terminal 650 may push a contact 642 of the microswitch. As described above, if the contact is pressed by the terminal 650, the installation of the dust collector may be detected.

A more detailed explanation of the microswitch is provided in U.S. patent application Ser. No. 11/956,133, which is hereby incorporated by reference.

Further, the magnetic sensor 620 that detects magnetism of the magnetic element 620 may be provided in the dust collector mounting element 170. The terminal 650 and the magnetic sensor 620 may be disposed vertically below a trajectory of the pressing element when the driven gear 410 is rotated.

The magnetic detection of the magnetic sensor 620 may be the same as that of the second magnetic sensor according to the previous embodiment. Therefore, detailed description has been omitted.

Figure 20:
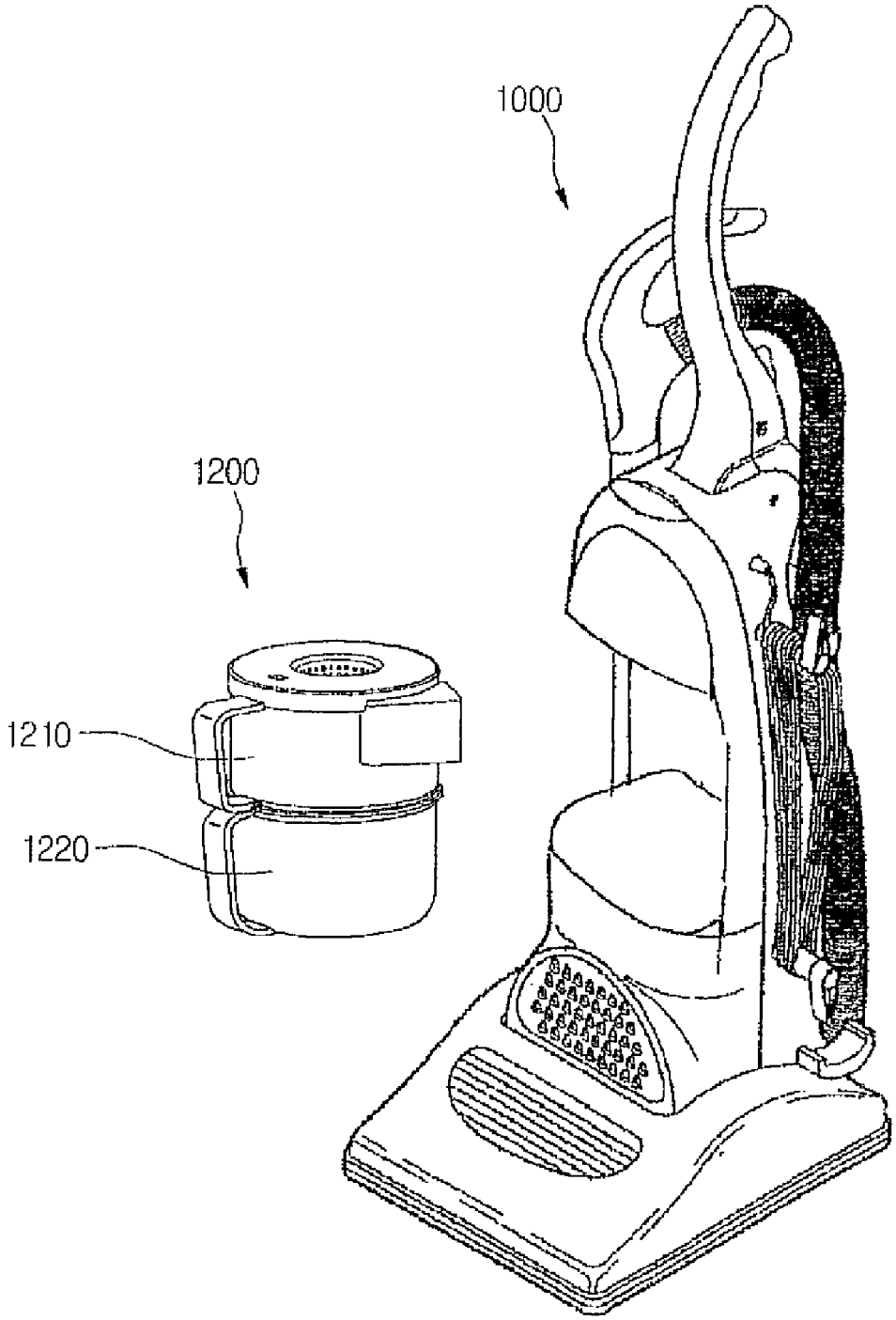
FIG. 20 is a front, perspective view of an upright vacuum according to an embodiment.

Any of the embodiments disclosed herein may be employed in an upright vacuum cleaner, such as the vacuum cleaner 1000 shown in FIG. 20. Further, the dust separator 1210 may be contained within the dust collector body 1220 or the dust separator 1210 may be separately provided from the dust collector body 1220. More detailed explanations of uptight vacuum cleaners are provided in U.S. Pat. Nos. 6,922,868 and 7,462,210, which are hereby incorporated by reference.

According to embodiments disclosed herein, the installation of the dust collector may be detected by the magnetic sensor or the microswitch. However, the installation of the dust collector may also be detected by using an infrared sensor or a sonar sensor of the dust collector mounting element.

In a vacuum cleaner according to embodiments disclosed herein, a dust-collecting capacity of the dust collector may be maximized, since dust stored in the dust collector may be pressed by the pressing element.

Embodiments disclosed herein have been derived to resolve disadvantages of the prior art. Embodiments disclosed herein provide a vacuum cleaner that increases dust-collecting capacity by compressing dust stored in the dust collector. Further, embodiments disclosed herein provide a vacuum cleaner that prevents a suction motor or a compression motor that compresses dust from operating when a dust collector is not mounted thereon.

Embodiments disclosed herein provide a vacuum cleaner that may include a cleaner body, in which a suction motor is provided; a dust collector selectively attached to the cleaner body, in which a dust container is formed; a pressing element that presses dust stored in the dust container; a compression motor that operates the pressing element; an installation sensor provided in a mounting element of the dust collector to detect whether the dust collector is correctly mounted; a signal display that displays a mount status of the dust collector; and a control unit or controller that controls the operation of the signal display.

In accordance with another embodiment, a vacuum cleaner is provided that may include a cleaner body, in which a dust collector mounting element is formed; a dust collector detachably attached to the dust collector mounting element, in which a dust container is formed; a pressing element movably provided in the dust container to press dust stored in the dust container; a magnetic element that moves with the pressing element when the pressing element moves; a magnetic sensor that detects a magnetism of the magnetic element; and a control unit or controller that determines a storage amount of dust stored in the dust container by using the magnetic information of the magnetic sensor.

In accordance with a further embodiment, a vacuum cleaner is provided that may include a cleaner body, in which a dust collector mounting element is formed; a dust collector detachably attached to the dust collector mounting element, in which a dust container is formed; a pressing element provided in the dust container to press dust stored in the dust container; an installation sensor provided in the dust collector mounting element that detects whether the dust collector is correctly mounted; and a position sensor provided in the dust collector mounting element that detects a position of the pressing element.

According to the embodiments disclosed herein, since dust stored in the dust collector is compressed and the volume of the dust is minimized, the capacity of dust stored in the dust collector may be maximized. Also, a user's inconvenience in having to frequently empty the dust stored in the dust collector may be solved or reduced, as the dust-collecting capacity of the dust collector may be maximized by a dust compressing operation.

Further, when a predetermined amount of dust is collected in the dust collector, a dust empty signal may be displayed, and therefore, it is possible for a user to easily recognize a time to empty the dust container. Furthermore, when an operation signal of the suction motor is input in a state in which the dust collector is not mounted thereon, unnecessary operations of the suction motor and the compression motor may be prevented by informing the user.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a cleaner body, in which a suction motor is provided;

a dust collector selectively attached to the cleaner body, in which a dust container is formed;

at least one pressing element that presses dust stored in the dust container;

a compression motor that drives the at least one pressing element;

an installation sensor provided in a dust collector mounting element that detects whether the dust collector is mounted on the cleaner body;

a signal display that displays whether the dust collector is mounted on the cleaner body; and a controller that controls operation of the signal display depending on whether the dust collector is mounted on the cleaner body.

2. The vacuum cleaner according to claim 1, wherein the installation sensor is disposed below the dust collector when the dust collector is mounted on the dust collector mounting element.

3. The vacuum cleaner according to claim 1, further comprising:

a power transmission device that transmits power of the compression motor to the at least one pressing element, wherein the power transmission device includes a driving gear connected to the compression motor and a driven gear connected to the at least one pressing element.

4. The vacuum cleaner according to claim 3, wherein the driven gear includes a magnetic element, and the installation sensor detects magnetism of the magnetic element.

5. The vacuum cleaner according to claim 1, wherein the installation sensor includes a terminal which is pressed when mounting the dust collector onto the cleaner body, and a microswitch connected to the terminal.

6. The vacuum cleaner according to claim 1, wherein a dust collector uninstallation signal is displayed on the signal display when the suction motor is activated in a state in which the dust collector is not mounted on the cleaner body.

7. The vacuum cleaner according to claim 1, further comprising:

a position sensor that detects a position of the at least one pressing element, wherein the controller determines an amount of dust in the dust container with reference to the position detected by the position sensor.

8. The vacuum cleaner according to claim 7, further comprising:

a power transmission device that transmits power of the compression motor to the at least one pressing element, wherein the power transmission device includes a driving gear connected to the compression motor, and a driven gear connected to the at least one pressing element.

9. The vacuum cleaner according to claim 8, wherein the driven gear is provided with a magnetic element, and the position sensor detects magnetism of the magnetic element.

10. The vacuum cleaner according to claim 7, wherein a dust empty signal is displayed on the signal display when an amount of dust stored in the dust container is greater than a reference amount.

11. The vacuum cleaner according to claim 1, wherein when the suction motor is activated in a state in which the dust collector is not mounted on the cleaner body, the compression motor is not operated.

12. A vacuum cleaner, comprising:

a cleaner body, in which a dust collector mounting element is formed;

a dust collector detachably attached to the dust collector mounting element, in which a dust container is formed;

at least one pressing element movably provided in the dust container to press dust stored in the dust container;

a magnetic element that moves with the at least one pressing element when the at least one pressing element moves;

a magnetic sensor that detects a magnetism of the magnetic element; and a controller that determines an amount of dust stored in the dust container based on the magnetism detected by the magnetic sensor.

13. The vacuum cleaner according to claim 12, further comprising:

a power transmission device that transmits a driving force from outside of the cleaner body to the at least one pressing element, wherein the magnetic element is provided in the power transmission device, and the magnetic sensor is provided in the dust collector mounting element.

14. The vacuum cleaner according to claim 13, wherein the power transmission device is a gear, and the magnetic sensor is disposed within a range of an imaginary circle along which the magnetic element rotates as the gear rotates.

15. The vacuum cleaner according to claim 12, wherein the controller determines the amount of dust by checking whether the at least one pressing element is disposed at a reference position, and measuring a turnaround time of the at least one pressing element, which is a time it takes the at least one pressing element to return to the reference position when rotated in a counter-clockwise or clockwise direction, after the at least one pressing element is rotated from the reference position in a clockwise or counter-clockwise direction.

16. The vacuum cleaner according to claim 15, wherein the reference position is a position at which the magnetic sensor detects magnetism of the magnetic element.

17. The vacuum cleaner according to claim 15, further comprising:

a signal display that displays a dust empty signal when a determined amount of dust is greater than a reference amount.

18. A vacuum cleaner, comprising:

a cleaner body, in which a dust collector mounting element is formed;

a dust collector detachably attached to the dust collector mounting element, in which a dust container is formed;

at least one pressing element provided in the dust container that presses dust stored in the dust container;

an installation sensor provided in the dust collector mounting element that detects whether the dust collector is mounted on the cleaner body; and a position sensor provided in the dust collector mounting element that detect a position of the at least one pressing element.

19. The vacuum cleaner according to claim 18, further comprising:

a compression motor that generates power; and a power transmission device that transmits the power of the compression motor to the at least one pressing element.

20. The vacuum cleaner according to claim 19, wherein a magnetic element is provided in the power transmission device, and the installation sensor and the position sensor detect magnetism of the magnetic element.

21. The vacuum cleaner according to claim 20, further comprising:

a controller that determines an amount of dust stored in the dust collector based on the position of the at least one pressing element detected by the position sensor.

* * * * *